US010611510B1

(12) United States Patent
Koch et al.

(10) Patent No.: US 10,611,510 B1
(45) Date of Patent: Apr. 7, 2020

(54) CHANNEL SLIDE LABEL APPARATUS

(71) Applicants: Paul Koch, Morris, NY (US); Julianne P. Koch, Morris, NY (US)

(72) Inventors: Paul Koch, Morris, NY (US); Julianne P. Koch, Morris, NY (US)

( * ) Notice: Subject to any disclaimer, the term of this patent is extended or adjusted under 35 U.S.C. 154(b) by 50 days.

(21) Appl. No.: 15/937,636

(22) Filed: Mar. 27, 2018

Related U.S. Application Data

(60) Provisional application No. 62/477,562, filed on Mar. 28, 2017.

(51) Int. Cl.
*B65C 9/18* (2006.01)
*B65C 9/26* (2006.01)
*B65C 9/00* (2006.01)

(52) U.S. Cl.
CPC ..... *B65C 9/1865* (2013.01); *B65C 9/0006* (2013.01); *B65C 9/0015* (2013.01); *B65C 9/262* (2013.01); *B65C 2009/0059* (2013.01)

(58) Field of Classification Search
CPC ..... B65C 9/26–36; B65C 9/183
See application file for complete search history.

(56) References Cited

U.S. PATENT DOCUMENTS 3,134,707 A * 5/1964 Carter ..... B65C 9/36 156/493
3,364,095 A * 1/1968 Govatsos ..... B43M 5/02 156/442
3,965,856 A * 6/1976 Scholl ..... B05C 1/003 118/202
4,059,203 A * 11/1977 Wright ..... B65C 9/0006 221/73
4,244,763 A * 1/1981 Varon ..... B65C 3/00 156/209
4,547,252 A * 10/1985 LaMers ..... B65C 9/1884 156/497
4,660,351 A * 4/1987 Saitoh ..... B65B 51/08 53/135.2
5,540,795 A 7/1996 Franklin et al.
5,779,852 A * 7/1998 Haney ..... B65C 9/262 156/523
5,879,507 A * 3/1999 Schroeder ..... B65C 1/021 156/361
6,440,249 B1 * 8/2002 Swinburne ..... B65C 9/183 156/230
7,160,412 B2 * 1/2007 Baumli ..... B65C 7/00 156/256
8,844,601 B2 * 9/2014 Kramer ..... B65C 9/1819 156/538
2003/0015105 A1 * 1/2003 Dewig ..... B41F 17/22 101/35

* cited by examiner

*Primary Examiner* — Charlie Y Peng

(57) ABSTRACT

An apparatus and method for applying a label on an article is described. The apparatus may include a first and a second channels. Each of the channels may comprise a first surface and a second surface positioned opposite the first surface. The second surface may comprise a curved edge. The curved edge may further comprise an open end curved towards the first surface. The applicator assembly may be used to provide assistance with applying a label held on a label securing assembly to an article. The first surface of each of the first channel and the second channel may be adapted to restrict a curvature of the label. The open end of the second surface of each of the first channel and the second channel may be adapted to contact an adhesive side of the label.

15 Claims, 27 Drawing Sheets

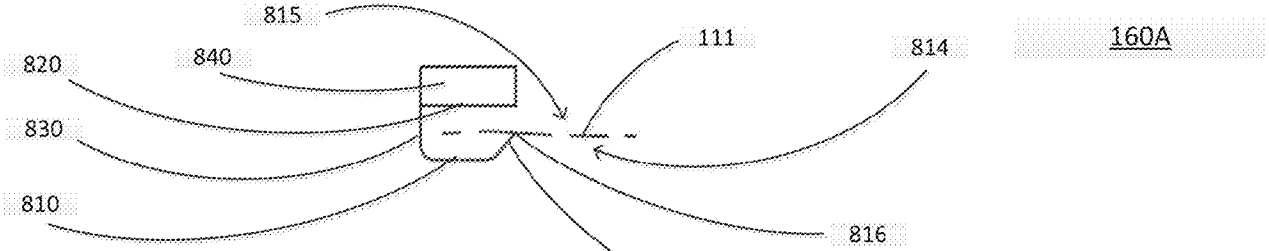
FIG. 8A
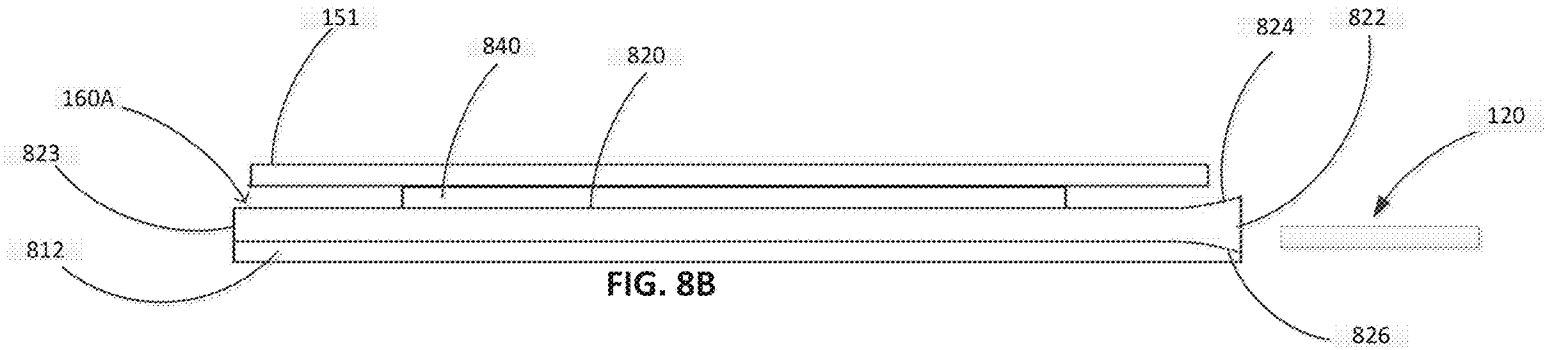
FIG. 8B
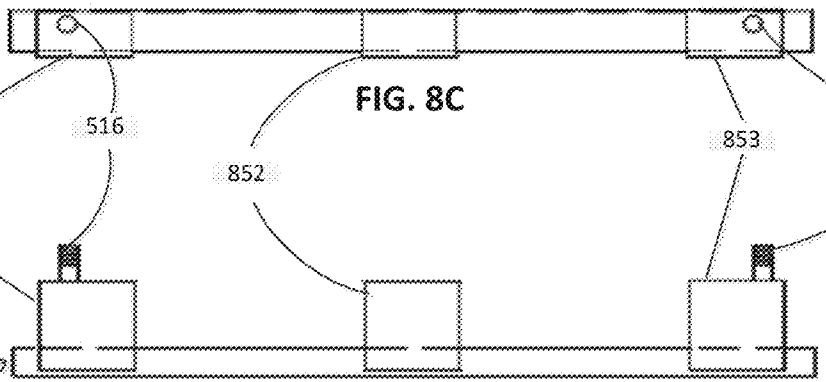
FIG. 8C
FIG. 8D
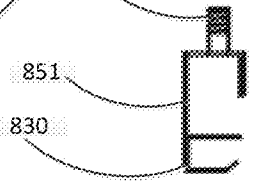
FIG. 8E

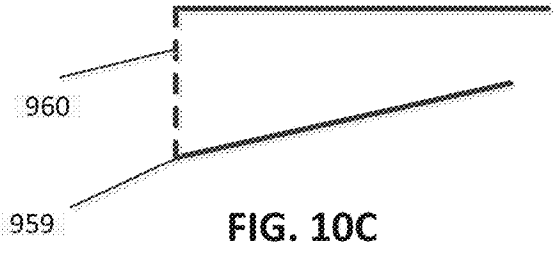
FIG. 10A
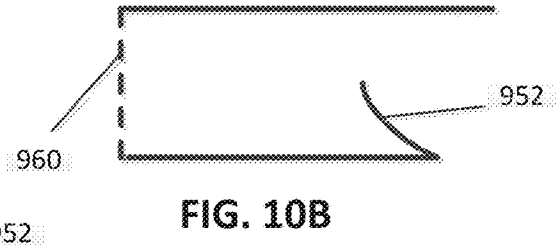
FIG. 10B
FIG. 10C
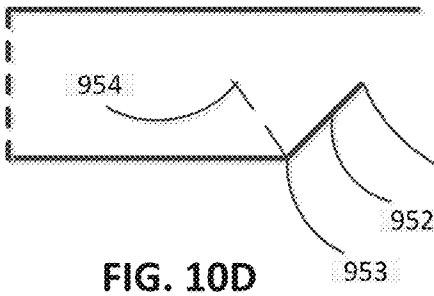
FIG. 10D
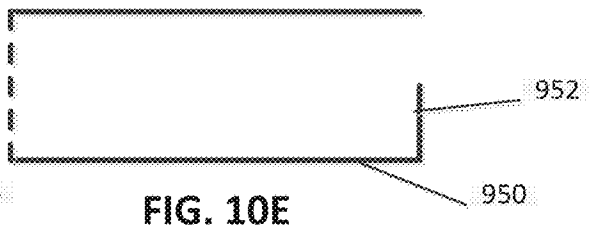
FIG. 10E
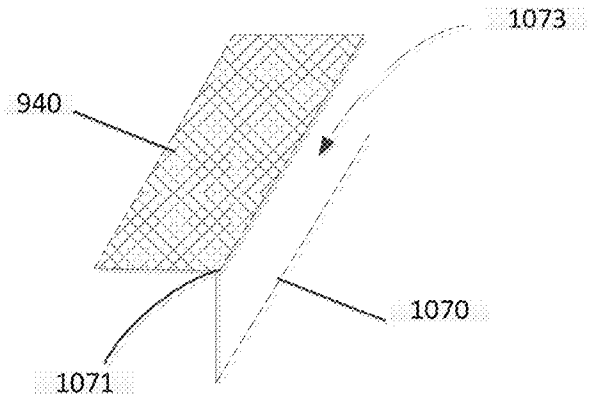
FIG. 10F
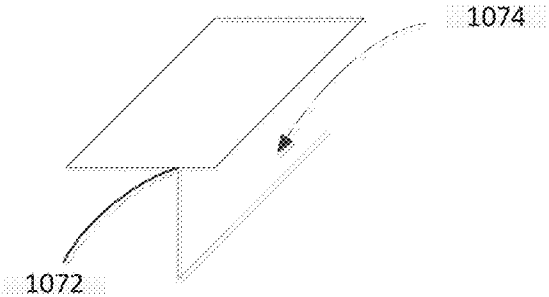
FIG. 10G

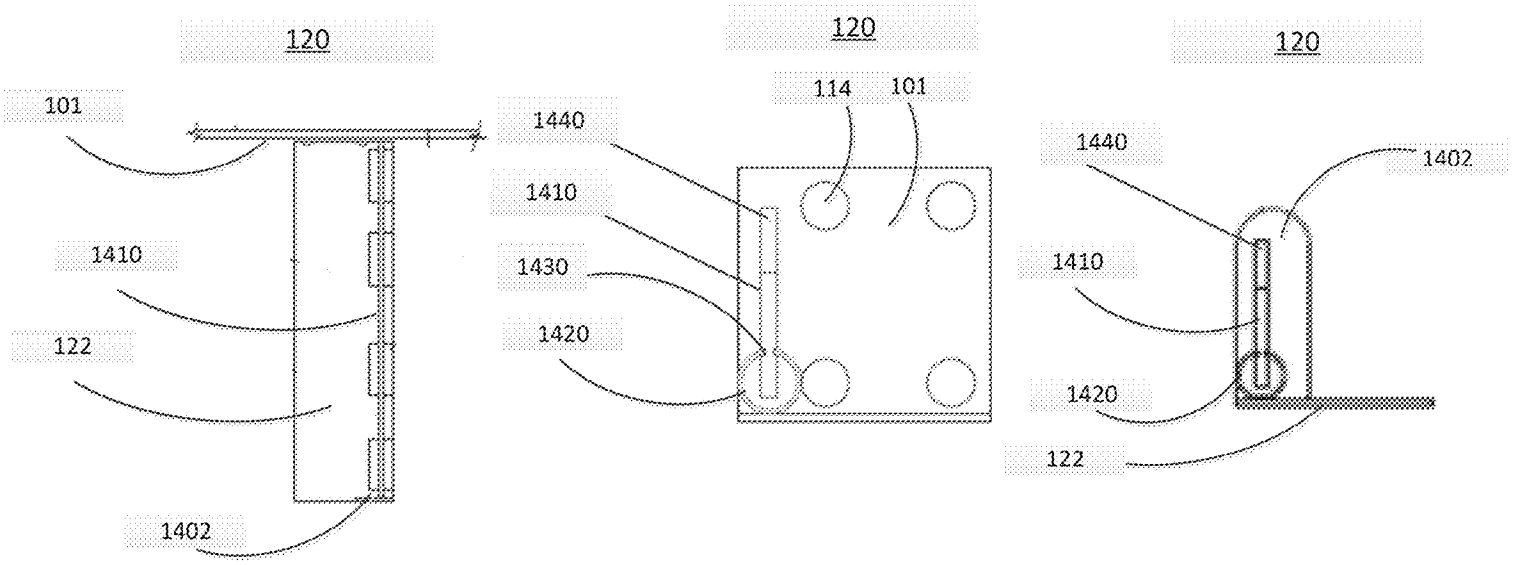
FIG. 14A
FIG. 14B
FIG. 14C
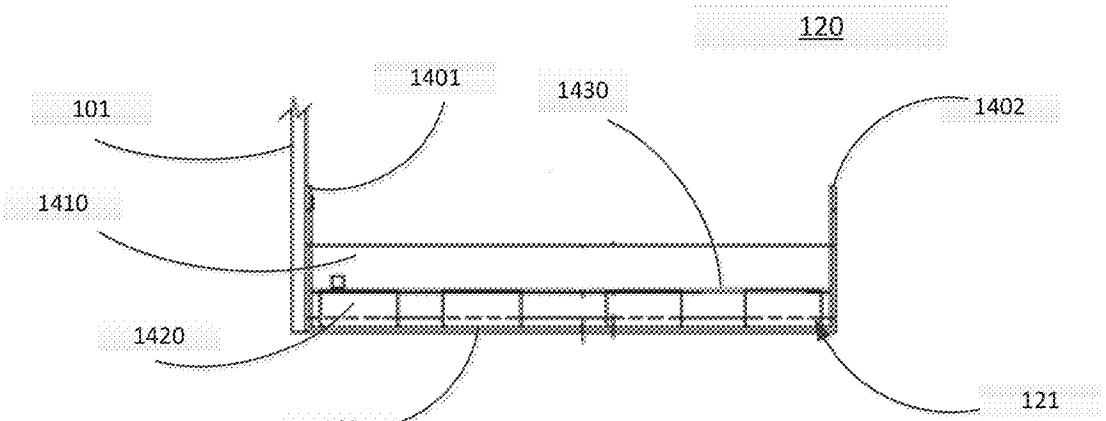
FIG. 14D

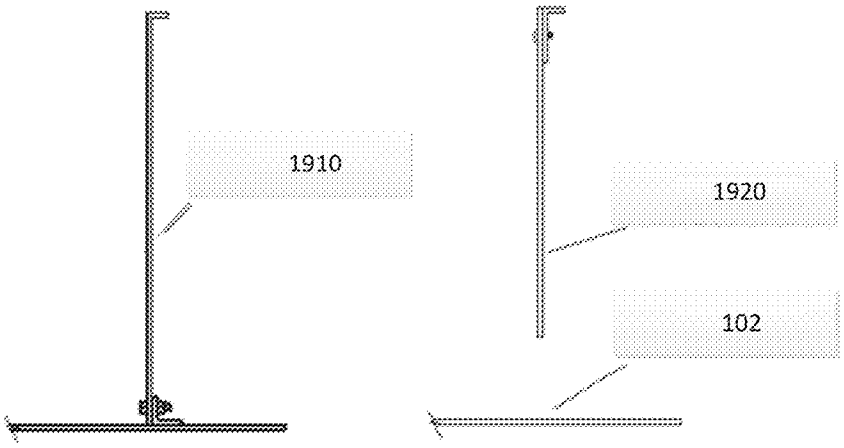
FIG. 19B
FIG. 19A
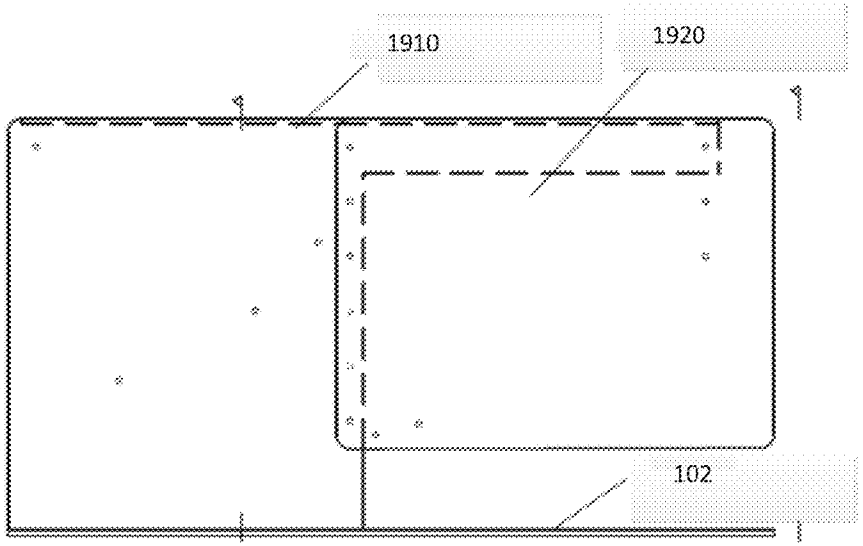
FIG. 19C

CHANNEL SLIDE LABEL APPARATUS

REFERENCE TO RELATED APPLICATIONS

The present application claims the benefit of priority to U.S. Provisional Application No. 62/477,562 filed Mar. 28, 2017, the disclosure of which is incorporated herein by reference in its entirety for all purposes.

TECHNICAL FIELD

The present disclosure generally relates to application of labels, and more specifically, relates to apparatus and methods for applying a label to an article.

BACKGROUND

Labels are used for various purposes, including for household uses to large production uses. Labels can be made of various materials and in different shapes. Labels can be separately produced and applied on various articles. The articles can be of different shapes and materials. For example, labels may be placed on, without limitation, paper, plastic, metal, packages, bottles, books, toys, etc. A standard shape of an article for labeling may include a flat surface. However, articles may be in different shapes, such as, without limitation, dome shaped, uneven surfaces, cylindrical, etc. A labelling apparatus can be used to assist with the application of a label on an article.

BRIEF DESCRIPTION OF THE DRAWINGS

The present disclosure will be understood more fully from the detailed description given below and from the accompanying drawings of various implementations of the disclosure.

FIGS. 8A-8E illustrate various views of a label securing assembly, in accordance with some embodiments of the present disclosure.

FIGS. 10A-10G illustrate various embodiments of receiving channels, in accordance with some embodiments of the present disclosure.

FIGS. 13 and 14A-14D illustrate a peel assembly, in accordance with some embodiments of the present disclosure.

FIGS. 19A-19C and 20A-20C illustrate various configurations of a mounting assembly, in accordance with some embodiments of the present disclosure.

DETAILED DESCRIPTION

Figure 1:
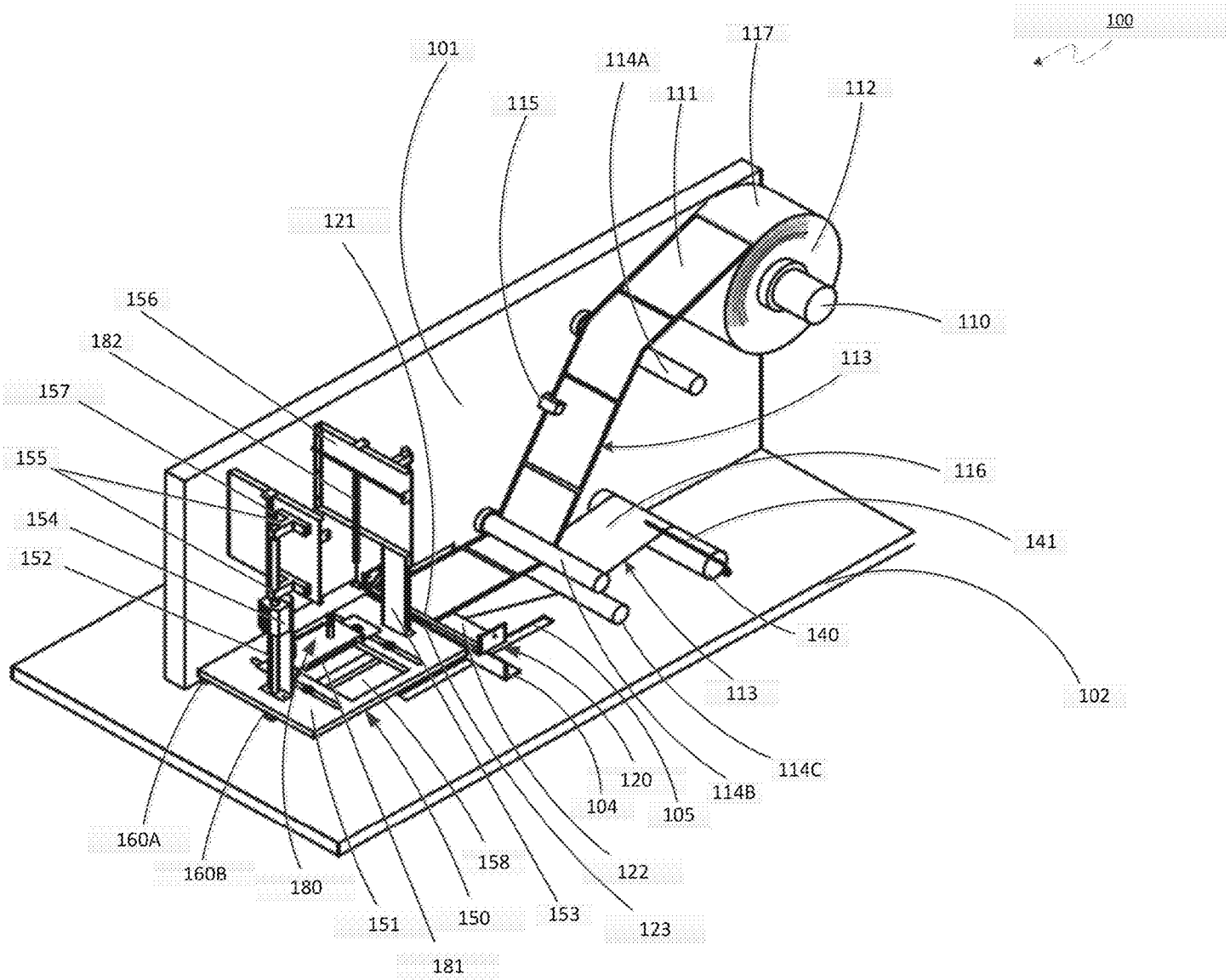
FIG. 1 illustrates a perspective view of an example apparatus for applying a label on an article in accordance with some embodiments of the present disclosure.

Aspects of the present disclosure are directed to an apparatus and method for applying a label to an article. Labels may come in various shapes and materials. For example, labels can be made with paper, fabric, metal, etc. Some labels are prepared (e.g., printed, crafted, etc.) and stored prior to being applied on an article. Some labels may be stored on a roll of backing material. Some labels may have an adhesive side that is designed to attach the label to an article. A label with an adhesive side is often referred to as a self-adhesive label. It is common to store self-adhesive labels on a strip of backing material and keep the strip wrapped around itself or around a spool on a roll. Some labels are prepared at the same time or immediately before being applied on an article. For example, an apparatus may be designed to print a label immediately before the label is to be dispensed and applied on an article. In some cases, the material on which the label is printed may be stored on a roll. In some cases, labels may be placed on an article first and afterwards be secured on the article with an attaching or fastening material, such as an adhesive material applied over the label, with a tape, staples, pins, etc.

A labeling apparatus can be used to assist with the application of a label. Some apparatuses may be used to detach the label from the backing material. Some may be used to affix the label to an article. Traditionally, various methods and apparatuses have been used for application of labels. For a label that is stored on a roll, the label develops an inherent curvature due to being rolled up while being stored. The developed curvature can cause the label to curl significantly when in a free state. Some labels may curl into spherical or nearly spherical shape. The curling causes challenges during application of the label onto an article, for example, causing the label to be disintegrated or destroyed, causing the label to be incorrectly applied in a curled state, etc. Once the label is unwound from the roll, keeping the label straight and preventing from curling can be challenging. Also, for self-adhesive labels, one of the challenges of label application is handling the label after removing the adhesive side of the label from the backing material and prior to applying it on the article. Since removal from the backing material exposes the adhesive side of the label, the label needs to be handled with caution. There is risk of the adhesive side coming in contact with parts of the labeling apparatus, or other surrounding objects. This can disintegrate the shape of the label and/or tangle up the label with other objects, causing errors in the application of the label. An effort to alleviate the problem with contacting the adhesive side may be made by avoiding touching the adhesive side with any parts of the labeling apparatus. One technique is to use a holding tool (e.g., vacuum tool, suction plate, etc.) to hold the label by the non-adhesive side of the label prior to application of the label. However, various challenges and limitations are involved with such a solution. Since a tool is used on the non-adhesive side for holding the label, it limits or eliminates space on the non-adhesive side for other types of tools to control the application of the label, especially for non-standard shaped articles which could benefit from extra support during application of the label. Majority of the times, such a holding tool involves complex designs, inconvenient supporting structure, and expensive materials. For example, a vacuum tool needs pneumatic mechanism and structures, which may be inconvenient for a labeler to be used in a smaller setup, such as at home or a small business. For a table top labeler, for instance, a vacuum tool or a suction plate may not be an ideal solution because of space constraints and having access to source of compressed air. Another technique involves wiping on parts of an adhesive label as the parts are being removed from the backing material. With traditional "wipe-on" methods, as the label is peeled off of the backing material, the exposed parts of the label is applied directly on a moving article concurrently. This requires coordination between peeling off the label from the backing material and the moving of the article. The speed of the peeling off the label and moving the article needs to be carefully controlled and coordinated. If the label is wrapped on a roll, the unwind speed of the roll also needs to be carefully controlled. Any discrepancy in these actions can cause errors in the application of the label. Traditional wipe-on labelers also require various parts to control and coordinate the movements, necessitating complex design and large space. Additionally, for hand held labelers, dispensing long labels present challenges due to the limitation of a hand held labeler being compact in size.

Aspect of the present disclosure address the above and other deficiencies by using a channel slide label apparatus for application of labels on an article. The label apparatus may include a mounting assembly, a peel assembly, a transfer assembly, a label securing assembly, and an applicator assembly. The mounting assembly may support various elements of the label apparatus. The peel assembly may be used to remove labels from backing material they are attached to. The transfer assembly may be used for transferring a label from the strip of labels to a temporary holding location and to ultimately transfer the label to an article. The label securing assembly may be used to secure a label prior to application to an article. The label securing assembly may include receiving channels. The receiving channels may be designed to restrict a curvature of the label while restraining the label in place. The receiving channels may be allowed to contact an adhesive side of label, however, the channels may provide for minimal contact with the adhesive side. Each of the receiving channels may comprise a first surface and a second surface positioned opposite the first surface. The second surface may comprise a curved edge. The curved edge may further comprise one open end curved towards the first surface. The applicator assembly may be used to provide assistance with applying a label held on a label securing assembly to an article.

Figure 2:
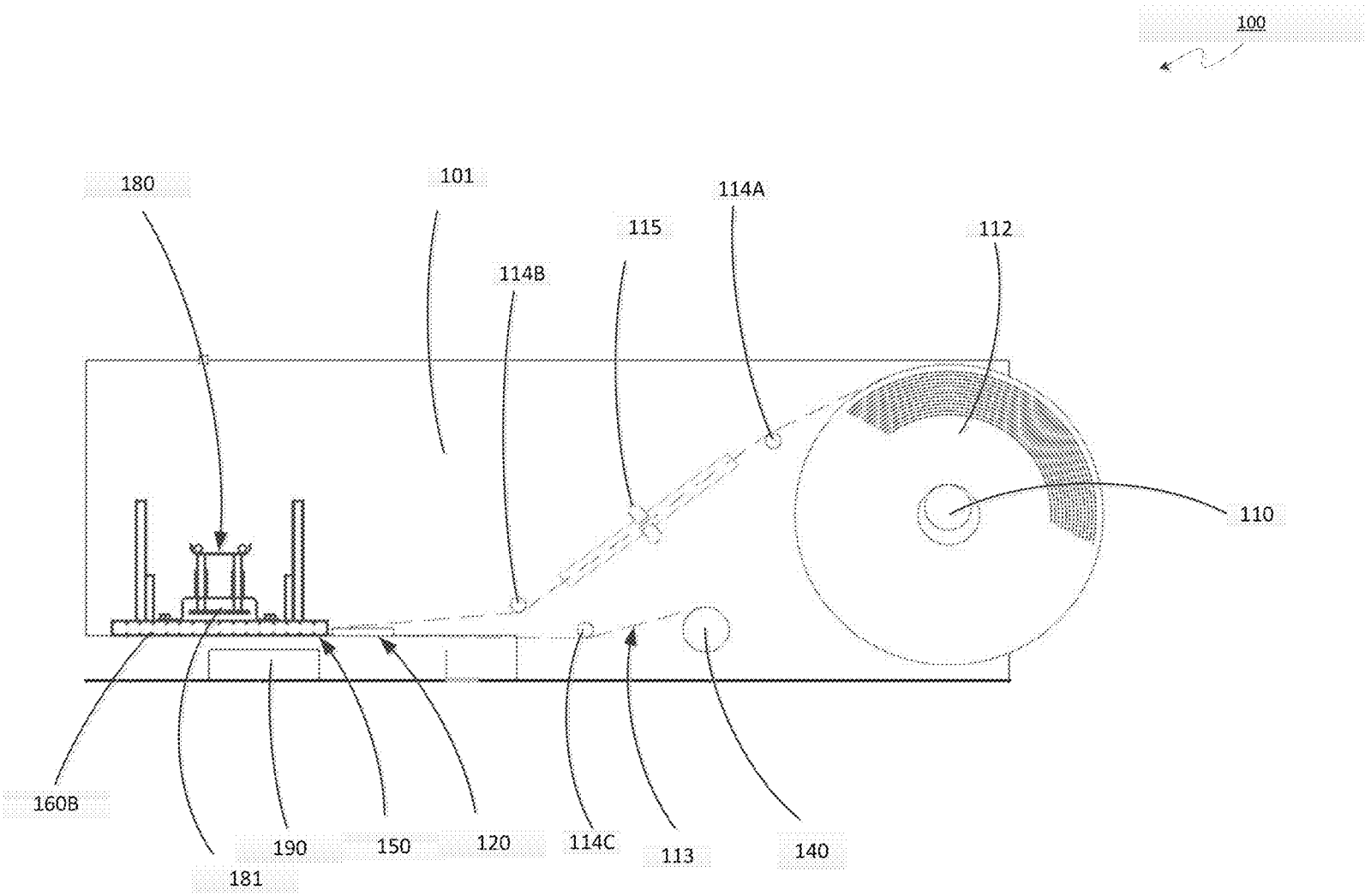
FIG. 2 illustrates a side view of an example apparatus for applying a label on an article in accordance with some embodiments of the present disclosure.
Figure 3:
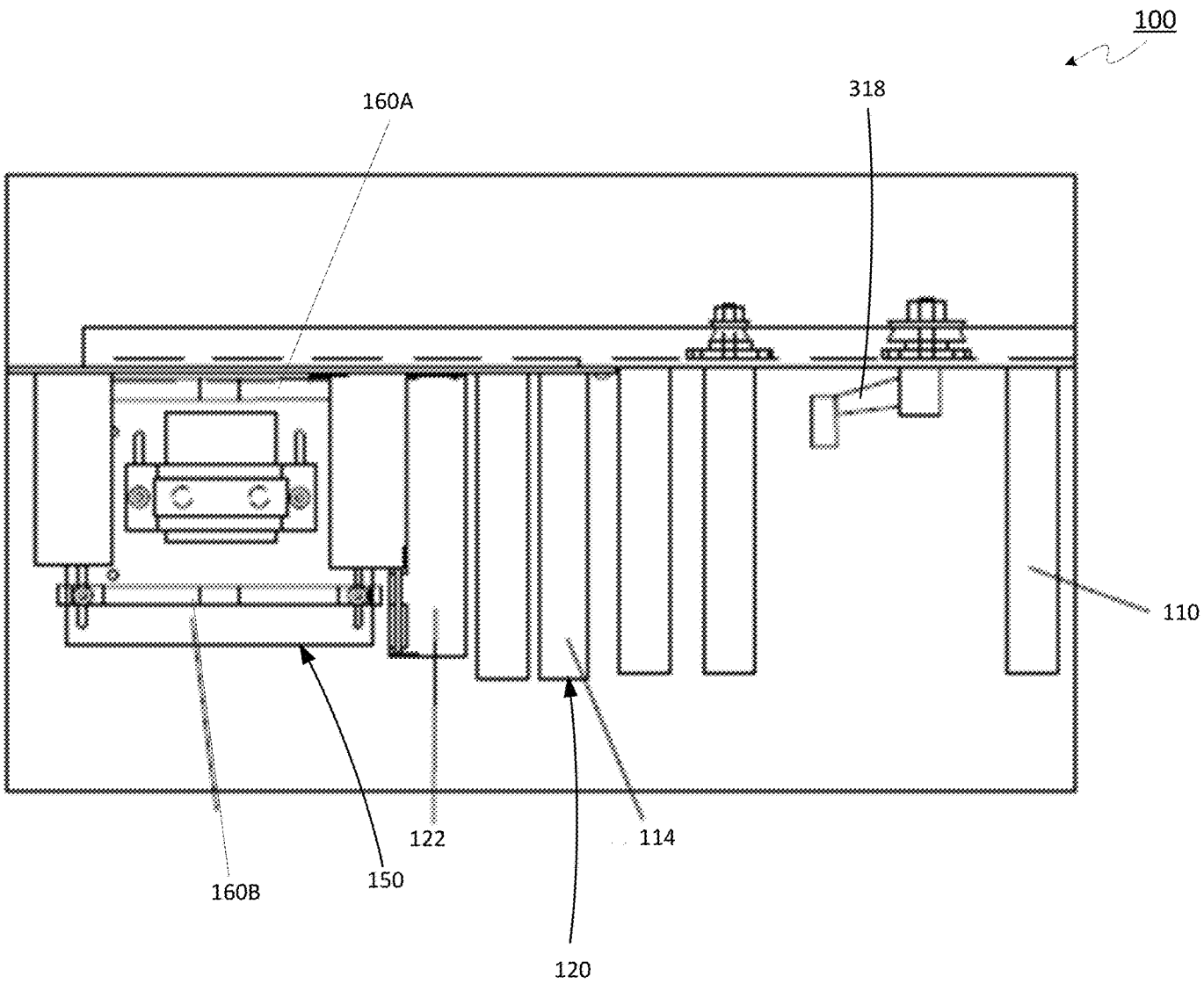
FIG. 3 illustrates a top view of an example apparatus for applying a label on an article in accordance with some embodiments of the present disclosure.
Figure 4B:
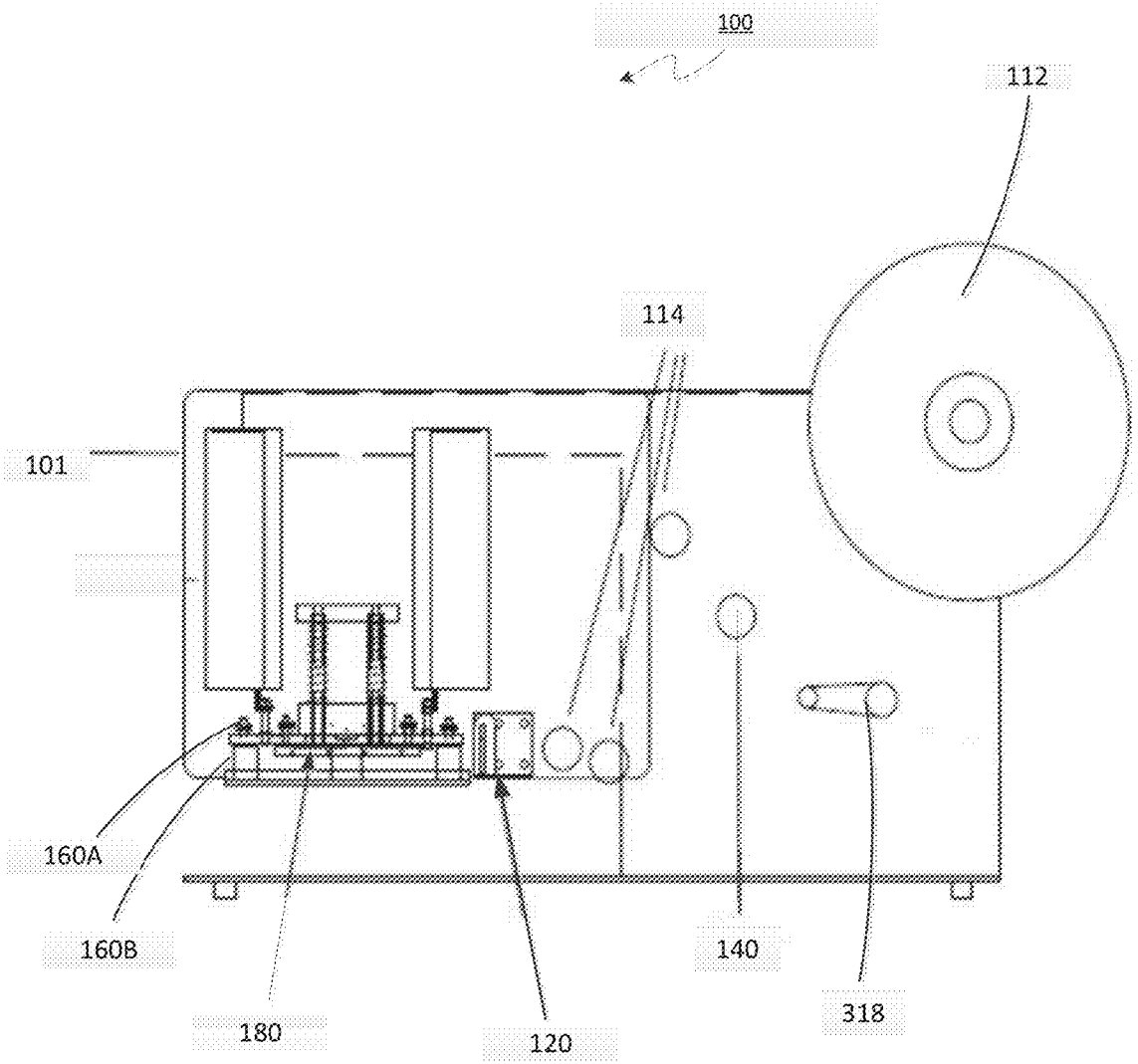
FIG. 4A illustrates a front view and FIG. 4B illustrates a side view of an example apparatus for applying a label on an article in accordance with some embodiments of the present disclosure.
Figure 4A:
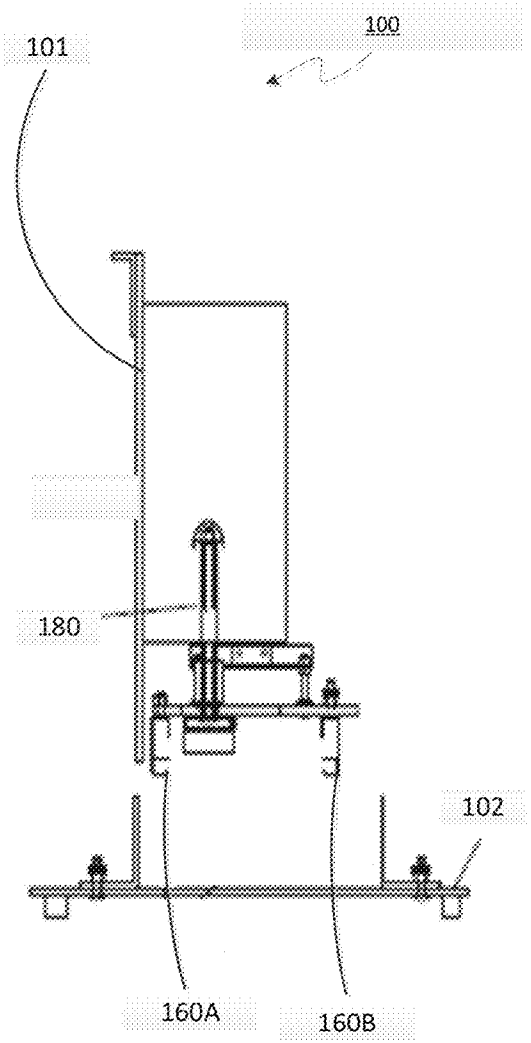

FIG. 1 illustrates a perspective view of an example apparatus 100 for applying a label on an article. FIG. 2 illustrates a side view of apparatus 100, FIG. 3 illustrates a top view of apparatus 100. FIG. 4A illustrates a front view of apparatus 100 and 4B illustrates another side view of apparatus 100. In an implementation, apparatus 100 may be a tabletop labeler. As shown in FIGS. 1 and 2, apparatus 100 may include a labeler mounting panel 101, a peel assembly 120, a label transfer assembly 150, and a tamp assembly 180. The label transfer assembly 150 may further include, or be connected to, a receiving channel 160A and a receiving channel 160B.

The label apparatus may include a mounting assembly. The mounting assembly may be used for mounting and supporting various parts of the label assembly and the strip of labels. For example, a mounting assembly may include a labeler mounting panel 101. Optionally, a mounting assembly may also include a floor plate 102. In one implementation, a spool holder 110 may be attached to labeler mounting panel 101. A label 111 may be supplied or stored on a roll 112. In an example, label 111 may be a self-adhesive label. Label 111 may be coated with an adhesive coating on one face ("adhesive side"). Label 111 may be mounted on a continuous strip 113 of backing material 116. The adhesive side of label 111 may be mounted on backing material 116. In an example, backing material 116 may include, but not be limited to, backing paper. Backing material 113 may also be made of other materials, such as, films, polyester, polypropylene, etc.

To set up the apparatus 100 for applying labels, label roll 112 may be mounted on spool holder 110. In some examples, apparatus 100 may include one or more guide rollers 114 and a light sensor gap detector 115. Guide rollers 114 may be used for guiding the strip 113 through the apparatus 100 towards peel assembly 120. A gap detector 115 (e.g., a light sensor detector) may be used to detect a gap between two labels on strip 113. Strip 113, including label 111 adhered on backing material 116, may be pulled over one of the guide rollers 114A and through light sensor gap detector 115. Strip 113 may be fed through (e.g., passed under) another guide roller 114B.

The label apparatus may include a peel assembly. The peel assembly may be used to remove labels from backing material they are attached to. In an implementation, strip 113 may be fed through peel assembly 120. For example, strip 113 may be fed through peel assembly 120 after being fed through guide roller 114B. Peel assembly 120 may include a peel bar 122 and a roller 121. In some examples, strip 113 may be wrapped around peel bar 122, such that strip 113 is pulled over a first face of peel bar 122 and subsequently pulled under the opposite face of peel bar 122, creating a sharp bend in strip 113. In some examples, strip 113 may be pulled in between roller 121 and the first face of peel bar 122 before wrapping under the opposite face of peel bar 122. Strip 113 may be passed through another guide roller 114C and end at a winding spool 140. In some examples, winding spool 140 may include a mechanical fastener 141. Fastener 141 may be used to keep strip 113 in place and fastened to winding spool 140, on which strip 113 is ultimately wound onto. Apparatus 100 may include an electric motor (not shown). In some examples, the electric motor may be a DC motor which may be attached to the winding spool 140. In an example, the DC motor may be located on the back side of the mounting panel 101 (e.g., the opposite side of where roll 112 is shown).

The label apparatus may include a transfer assembly. The transfer assembly may be used for transferring a label from the strip of labels to a temporary holding location and to ultimately transfer the label to an article. In an implementation, transfer assembly 150 of apparatus 100 may be designed to hang vertically. Transfer assembly 150 may be connected to mounting panel 101. In an example, and be allowed to move vertically up and down. In another example, transfer assembly 150 may be allowed to move side to side, or in another orientation. Transfer assembly 150 may include a transfer tray 151. Transfer tray 151 may be used to support various parts used to manipulate and apply label 111. In an implementation, transfer tray 151 may be attached to a pair of hanger plates 153. Hanger plates 153 may be mounted on a pair of linear slide bearings 154, respectively. Thus, transfer tray may be hung from the slide bearings 154. Slide bearings 154 may travel along vertical shaft rods 152. Shaft rods 152 may be mounted within one portion of shaft rod supports 155. Another portion of shaft rod supports 155 may be connected to hanger brackets 156, which in turn may be mounted on labeler mounting panel 101. Extension springs 157 connect between hanger plates 153 and hanger brackets 156. Extension springs 157 may be used to hold the transfer tray 151 in its uppermost position (e.g., label receiving position) while label 111 is being received by the transfer assembly 150 and also allow the transfer tray 151 to be lowered to a lower position (e.g., label applying position) when the label 111 needs to be released from the transfer tray 151 and applied on an article.

The label apparatus may include a label securing assembly. The label securing assembly may be used to secure a label prior to application to an article. In an implementation, a label securing assembly may include receiving channels. For example, transfer assembly 150 may include, or be connected to, label receiving channels 160A and 160B. In an example, label receiving channels 160A and 160B may be attached to the underside of transfer tray 151. In another example, label receiving channels 160A and 160B may be attached to the top of transfer tray 151 or a side of the transfer tray 151. The receiving channels 160A and 160B may be positioned adjacent to the peel assembly 120. Label receiving channels 160A and 160B may be used to secure label 111 after label 111 is removed from backing material 116, sliding into the channels. The receiving channels may be designed to restrict a curvature of the label 111 while restraining the label 111 in place. The receiving channels may be allowed to contact an adhesive side of label 111, however, the channels provide for minimal contact with the adhesive side. In some implementations, transfer assembly 150 may include a gap 158 (e.g., hole, cavity) near the center of the transfer tray 151, and between label receiving channels 160A and 160B. The gap may accommodate various types of tools for use in the control and application of labels on various types of articles.

The label apparatus may include an applicator assembly. The applicator assembly may be used to provide assistance with applying a label held on a label securing assembly to an article. For example, an applicator assembly may include a tamp assembly 180. In some implementations, a tamp assembly 180 may be accommodated adjacent to the gap 158 within the transfer tray 151. Tamp assembly 180 may include a tamp plate 181. The longitudinal dimension of tamp plate 181 may be relatively narrower than the gap 158 in the transfer tray 151, allowing tamp plate 181 to pass through the gap 158. Tamp assembly 180 may be connected to the hanger brackets 156 through extension springs 182. Extension springs 182 may hold the tamp assembly 180 at a level above the receiving channels 160A and 160B, or higher than transfer assembly 150, while the label 111 is being received by the transfer assembly 150. Extension springs 182 may allow the tamp plate 181 to be lowered passed the receiving channels 160A and 160B when the label 111 needs to be appended to an article.

Once the label apparatus is set up with a strip of labels, the various parts of the apparatus may be used to remove a label from the strip of labels and apply it on an article. As described previously, label roll 112 may be mounted on spool holder 110 and strip 113 may be fed through guide rollers 114 and peel assembly 120 and end at winding spool 140. Initially, backing material 116 of strip 113 may be temporarily attached to the winding spool 140 with mechanical fastener 141. Backing material 116 may be wound onto winding spool 140 using various mechanisms. For example, a manual rotating device, such as a hand crank (such as, hand crank 318 shown in FIGS. 3 and 4B) or a foot pedal may be attached to winding spool 140 to turn the winding spool 140. In another example, a DC motor may drive the winding spool 140. A DC motor or a manual rotating device (not shown) may be attached to a side of the winding spool 140, such as on the back side of the mounting panel 101. As backing material 116 is wound onto winding spool 140, strip 113 is drawn from roll 112 and the labels, including label 11, on the strip 113 may advance forward.

When using a DC motor, as strip 113 advances towards peel assembly 120, strip 113 may pass through gap detector 115. As strip 113 passes through gap detector 115, a gap between two labels may be detected by gap detector 115. For example, as label 111 on strip 113 passes through gap detector 115, a gap between label 111 and the following label 117 may be detected. When a gap is detected, gap detector 115 may send a signal to the DC motor to stop the motor from turning winding spool 140, in turn stopping the advancing of strip 113. The position of gap detector 115 may be adjustable. By adjusting the position of gap detector 115, it may be possible to control the position of the leading edge of label 111 when the motor stops in order to position the leading edge of label 111 appropriately for peel assembly 120 and transfer assembly 150. Alternative means may be used for controlling the label position when the motor stops, such as through electronic microcontroller circuitry.

As strip 113 advances forward, label 111 may reach peel assembly 120. Peel assembly 120 may be used to remove label 111 from strip 113 of backing materials 116. Backing material 116, with label 111 attached to it, may bend around a sharp edge 123 of peel bar 122 as strip 113 advances forward. The backing material, being wound at winding spool 140, continues bending and advancing towards guide roller 114C and winding spool 140. However, label 111, being attached to backing material 116 with adhesive only, gets removed from the backing material 116 at the sharp edge 123 of peel bar 122. In some examples, label 111 may resist following the bend at the sharp edge 123 because label 111 may be stiffer than the backing material 116. Label 111 continues in a straight line. As the label 111 is being removed from strip 113, the label 111 may be positioned to be transferred to transfer assembly 150. As label 111 separates from backing material 116, the leading edge of the label 111 may move within the transfer assembly 150.

As discussed previously, an intrinsic curvature develops on the label as a result of being stored on a roll and may cause the label to curl at a free state. When majority of the label is removed from the backing material, the remaining portion of the label tends to detach from the backing material automatically, even prior to reaching the sharp edge of the peel bar. This may be due to the shape of the label being inherently curved and the curvature may override the strength of the adhesive holding the minimal portion attached with the backing material. This may also be due to the friction resistance of the label sliding in the channels. The friction can overcome the adhesive bond between the label and the backing material when there is very little portion of the label left in contact with the backing material, and get removed from the backing material prior to entering the channels. If a portion of the label curls and exposes the adhesive side before entering the transfer assembly, the label may get adhered to an external element of the apparatus, may not be able to enter the transfer assembly, or enter the transfer assembly in a deformed shape. As label 111 continues to move within transfer assembly 150, roller 121 positioned above peel bar 122 may provide a downward pressure on the top surface of label 111. The pressure applied by roller 121 keeps the portion of the label 111 between peel bar 122 and roller 121 secured to backing material 116. The purpose is to keep the portion of the label that is passing through the peel assembly, which is still outside of the transfer assembly 150, attached to the backing material 116 until the last edge of the label passes through peel assembly 150. As a result, an external pressure helps prevent the last portion of the label from detaching and curling prior to entering the transfer assembly.

As the label is removed (e.g., peeled off) from the strip of backing material, the label may be transferred to the transfer assembly. The label may slide into the label securing assembly where the label is held securely prior to being applied on an article. The label securing assembly is designed in a way that the label can be held by the exposed adhesive side with minimal contact so that the label does not get affixed to the label securing assembly. Alternatively, in a configuration where the label is applied below an article and the adhesive side is faced upwards, the label may be supported on or held by the non-adhesive side and the channels provide minimal contact with the label adhesive side while the label is slid onto the channels. Since the label can be held within the label securing assembly for as long as necessary and is independent of the state of the article, there is no need to coordinate between the speed of the strip advancement and movement of the article. The label can be released from the label securing assembly when the article is placed in an appropriate position where it can receive the label. For example, the leading edge of label 111 may be positioned parallel to receiving channels 160A and 160B. Label 111 may slide into receiving channels 160A and 160B attached to transfer assembly 150 as label 111 is separated from backing material 116. When label 111 finishes detaching from the backing material 116, label 111 may fully rest within the channels 160A and 160B. At this point, the gap detector 115 may send a signal to the DC motor to stop turning spool 140 and advancing strip 113. The receiving channels may have two parallel surfaces (not shown), where a first surface contacts the non-adhesive side of the label and a second surface may contact the adhesive side of the label. The surface contacting the adhesive side may have a slightly upturned edge from the remainder of the second surface, which ensures that there is only a minimal contact between the adhesive side of the label and the second surface of the receiving channel. The first surface is adapted to restrict the inherent curvature of the label and keep the label on a flat plane. Otherwise the label would curl and be deformed prior to application to an article. The label securing assembly is described in further details in FIGS. 8A-8E, 9A-9D, etc.

An article 190 (as shown in FIG. 2) may be placed under the transfer assembly on floor plate 102. The label is to be applied to article 190. In one embodiment, the apparatus is designed such that an operator may apply a pressure on an applicator assembly (e.g., tamp assembly 180) in order to append the label on the article. In an example, the applied pressure causes the tamp assembly 180 and the transfer assembly 150, along with the label securing assembly (e.g., receiving channels 160A and 160B), to move towards the article until the receiving channels reaches the article. The receiving channels may be designed to be stopped when the channels come in contact with the article, or a particular distance prior to coming in contact with the article. For example, a sensor may be used to detect the distance between the channels and an article. While the receiving channels are stopped, the pressure on the tamp assembly 180 continues to move, crossing the first surface of the receiving channels and coming into contact with label 111. As pressure is continued to be applied on the tamp assembly 180, transfer assembly 150 is designed to be released from the tamp plate 181 and travel back upwards upon release. Tamp plate 181 is held down by the operator, which restrains the label 111 from being carried up with the transfer assembly 150. Label 111 can slide out of receiving channels 160A and 160B and continues moving downwards along with tamp plate 181 until the label makes contact with the article. The pressure from tamp plate 181 may affix label 111 to the article. In another example, the affixing can also be accomplished with a blast of compressed air. The operator may release the tamp plate 181, which may rise up due to extension springs attached to tamp plate 181. The labeled article may be replaced with a different article and the operator may restart the process by starting the DC motor or the manual rotating device.

The foregoing disclosure describes a preferred embodiment of a tabletop label apparatus. The orientation of the apparatus and elements of the apparatus may be varied in other embodiments. For example, in one embodiment the apparatus may be turned 180 degrees, or upside down, as compared to the arrangement of the apparatus 100 shown in FIG. 1. In another embodiment, a combination of an apparatus 100 as shown in FIG. 1 and another label apparatus turned upside down and placed below the transfer assembly 150 of apparatus 100 may comprise a label apparatus to apply labels from a top and a bottom side of an article. In yet another configuration, some parts of the apparatus 100 (such as, transfer assembly 150, peel bar 120, tamp assembly 180, etc.) may be turned 90 degrees, or sideways. For each configuration, a person skilled in the art would appreciate and adjust placement of various elements of the apparatus, and/or use an alternative element in some examples, such that same or similar functionalities of the label apparatus as described in terms of the preferred embodiment can be achieved.

Figure 5:
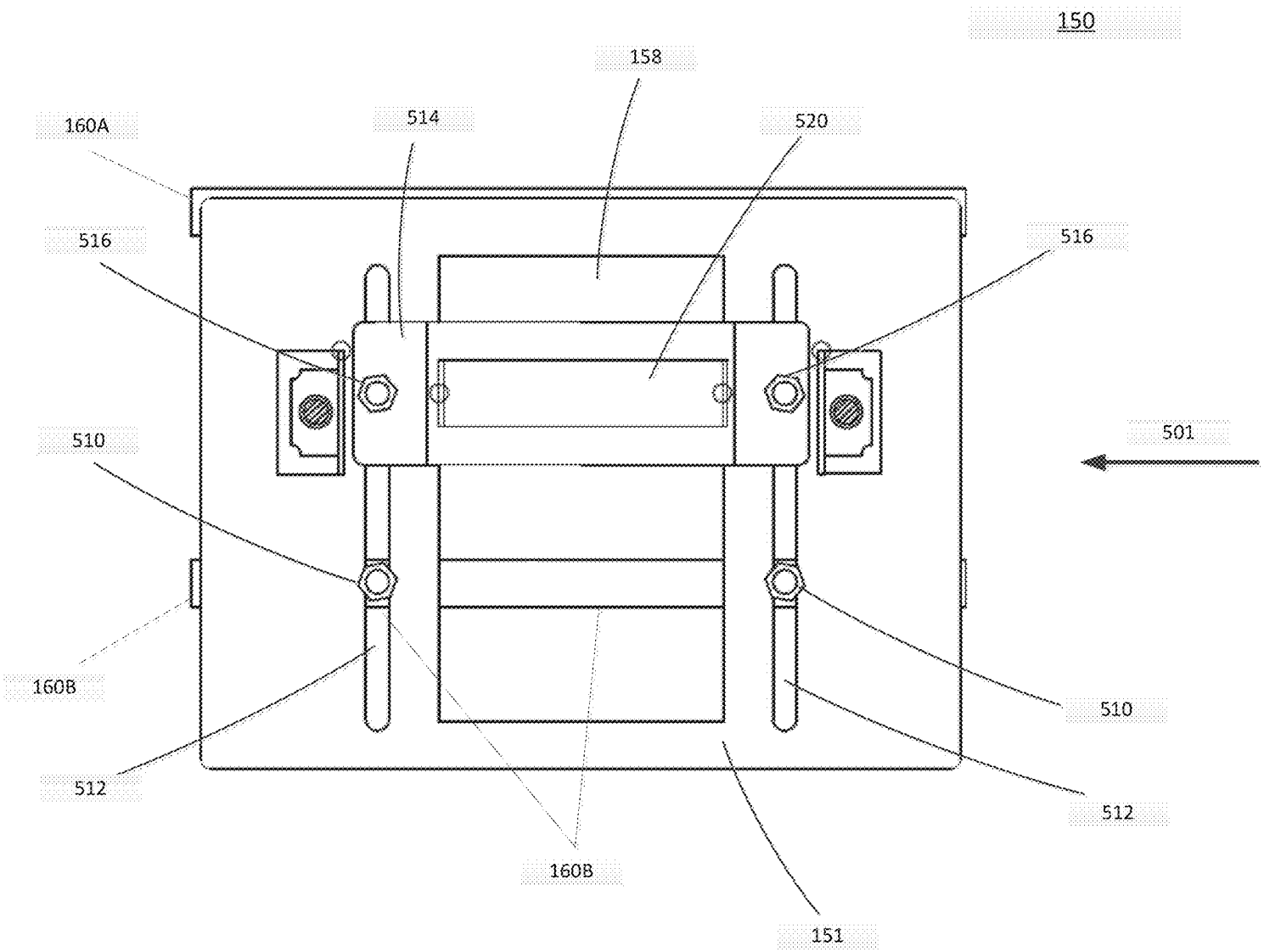
FIG. 5 illustrates a top view of a transfer assembly in accordance with some embodiments of the present disclosure.
Figure 6:
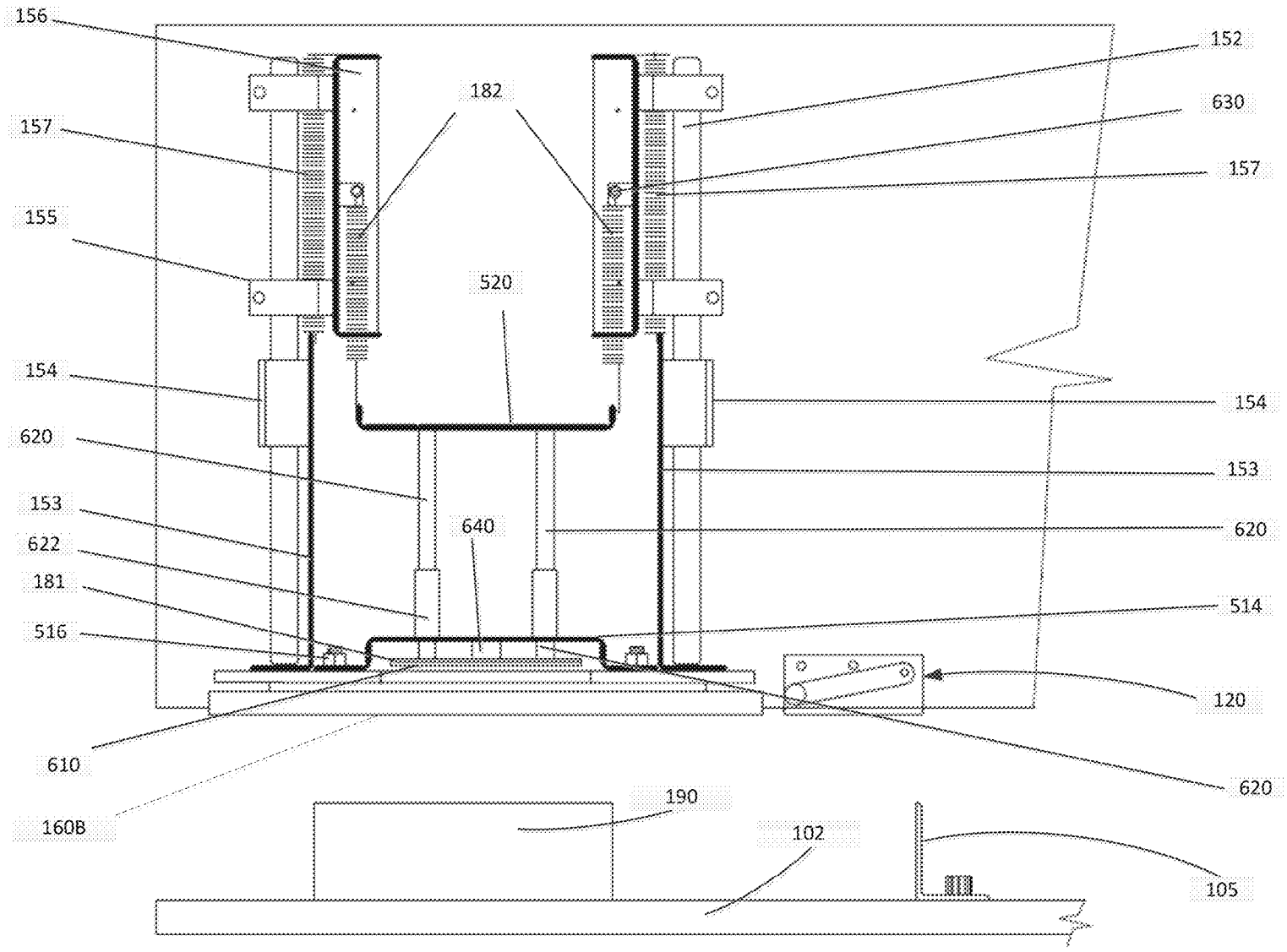
FIG. 6 illustrates a side view of a transfer assembly in accordance with some embodiments of the present disclosure.

FIG. 5 illustrates a top view of transfer assembly 150. FIG. 6 illustrates a side view of transfer assembly 150 and tamp assembly 180. Transfer assembly 150 may include a transfer tray 151. Transfer tray 151 may be made of various materials, such as, wood, plastic, metal, etc. A clear material may allow an operator of the apparatus 100 to see label 111 when it travels to transfer tray 151. However, an opaque material, such as metal, may also be used. In an example, label receiving channels 160A and 160B may be attached to the underside of transfer tray 151. The receiving channels 160A and 160B may be positioned such that label edges can be parallel to the channels as the labels enter the channels. One or both of the receiving channels may be coupled to transfer tray 151 adjustably to accommodate labels of differing width. For example, receiving channel 160B is depicted as being fastened to transfer tray 151 using short threaded studs 510. Transfer tray 151 may include elongated mounting holes 512. Mounting holes 512 expand across the width of tray 151, allowing threaded studs 510 to be placed in various locations of transfer tray 151. This allows the receiving channels to be configured according to a necessary width for accommodating labels of differing dimensions. Mounting holes 512 may be oriented transverse to the label feed direction 501. Nuts (not shown) may thread onto the studs 510 to fasten the receiving channel 160B to the transfer tray 151 at the desired position for the label being applied.

Transfer assembly 150 may include a gap 158 (e.g., hole, cavity) near the center of the transfer tray 151. A tamp plate positioning bar 514 may be mounted on the transfer tray 151 across gap 158 with bolts 516 that pass through mounting holes 512. Mounting holes 512 may allow tamp plate positioning bar 514 location to be adjusted to accommodate labels with different dimensions. A tamp plate bar 520 may be attached to tamp plate rods 620 (as shown in FIG. 6) that connect tamp plate bar 520 to tamp plate positioning bar 514.

As shown in FIG. 6, transfer tray 151 may be attached to a pair of hanger plates 153. Hanger plates 153 may be attached to a pair of linear slide bearings 154, respectively. Thus, transfer tray may be hung from the slide bearings 154. Slide bearings 154 may travel along vertical shaft rods 152. Shaft rods 152 may be mounted within one portion of shaft rod supports 155. Another portion of shaft rod supports 155 may be connected to hanger brackets 156 mounted on labeler mounting panel 101. Extension springs 157 connect between hanger plates 153 and hanger brackets 156.

Gap 158 may accommodate tamp plate 181. Tamp plate 181 may be made of various materials, according to the need for the type of an article to be labeled. In an example, tamp plate 181 may be constructed of metal. In another example, tamp plate 181 may be constructed of foam. In an example, the bottom surface of tamp plate 181 may be covered with a silicone rubber pad 610. In an example, the bottom surface may include a brush. A brush may help with applying a label on a curved or uneven surface. The longitudinal dimension of tamp plate 181 may be relatively narrower than the gap 158, allowing tamp plate 181 to pass through the gap 158. Tamp plate 181 may be positioned between the two receiving channels 160A and 160B. In some examples, tamp plate 181 may be centered between the channels. In some examples, tamp plate 181 may be positioned slightly above the channels. Tamp plate rods 620 may be attached to the top surface of tamp plate 181. Guide sleeves 622 may be mounted on top of the tamp plate positioning bar 514. Tamp plate rods 620 may pass through guide sleeves 622. Tamp plate bar 520 may be attached to the top end of rods 620.

Spring holding rods 630 may be mounted on hanger brackets 156. Extension springs 182 may connect between tamp plate bar 520 and spring holding rods 630. Extension springs 182 may hold the tamp plate 181 at a level above the receiving channels 160A and 160B, or higher than transfer assembly 150, while the label 111 is being received by the transfer assembly 150. In one example, a magnet 640 may be mounted on the top surface of tamp plate 181. Magnet 640 may connect tamp plate 181 to the tamp plate positioning bar in a releasable manner. In another example, a mechanical or electromechanical catch may be used in place of the magnet 640.

Figure 7B:
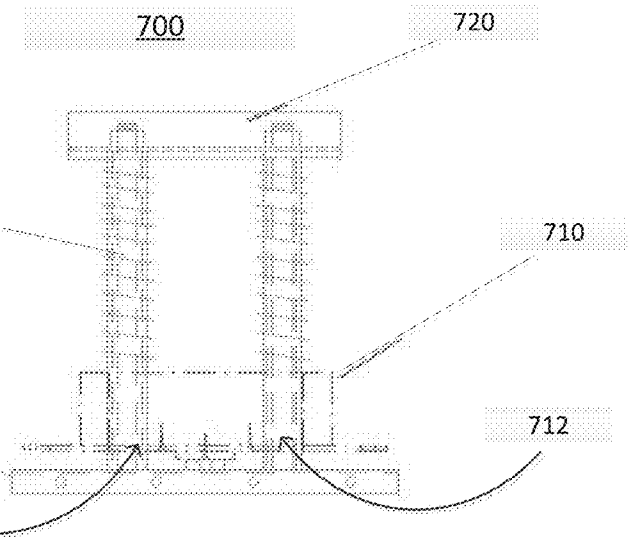
FIGS. 7A-7D illustrate various views of an applicator assembly, in accordance with some embodiments of the present disclosure.
Figure 7A:
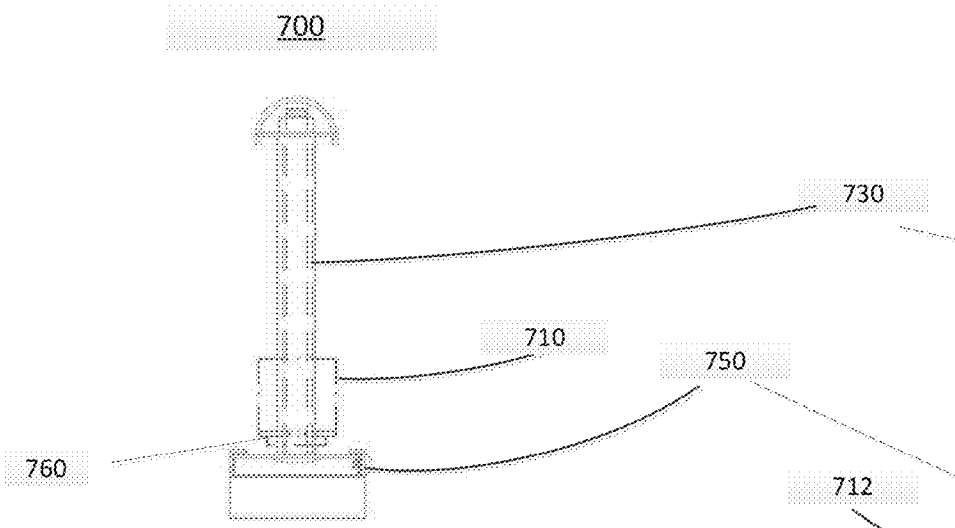
Figure 7D:
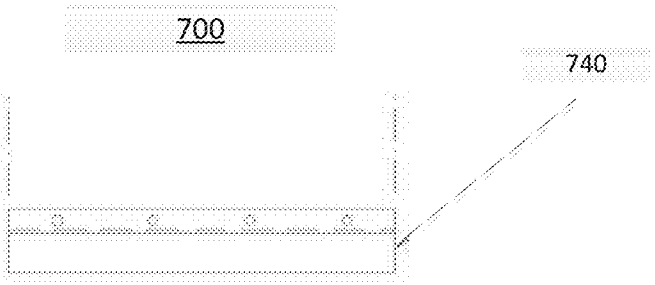
Figure 7C:
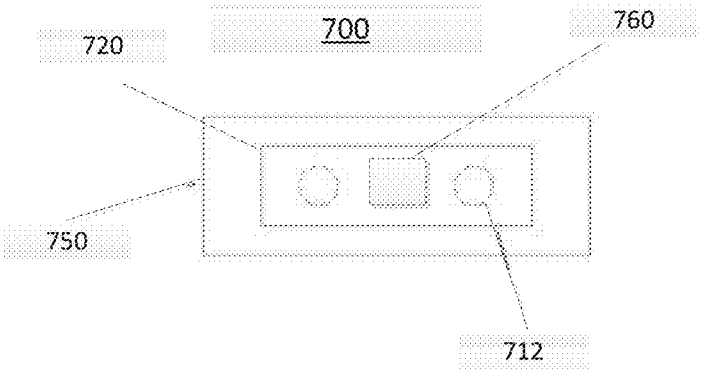

FIGS. 7A-7D illustrates an alternative embodiment of an applicator assembly. FIG. 7A shows a front view, FIG. 7B shows a side view, and FIG. 7C shows a top view of an applicator assembly 700. FIG. 7D shows a portion of the applicator assembly 700. Applicator assembly 700 may be comparable to tamp assembly 180. In an embodiment, applicator assembly 700 may include a tamp pad 750 (comparable to tamp plate 181) and a tamp press guide 710 (comparable to guide sleeves 622). Tamp press guide 710 may be attached to transfer tray 151. A tamp press handle 720 (comparable to tamp plate bar 520) may be moved up and down to apply the label. Tamp press guide 710 may have two holes 712 that may provide a track for the tamp press handle 720 to slide up and down through the tamp press guide 710. In an example, tamp press guide 710 may be constructed from a block of plastic with two holes drilled in it. In some example, applicator assembly 700 may include compression springs 730 for allowing the up and down movement. In some example, instead of compression springs 730, extension springs may be used. In some examples, levers may be used to depress the tamp plate 181. The lever may have a torsion spring to replace compression spring 730. A magnet catch plate 760 (comparable to magnet 640) may be attached to the bottom surface of tamp press guide 710. In some embodiments, as shown in FIG. 7D, tamp pad 750 may be covered with, or attached to, an extra material, such as a foam pad 740. Alternatively, a brush may be used with the tamp pad. The extra material may be selected based on the article being labeled. In some implementations, in place of compression springs 730, extension springs can be used. In some implementations, the tamp plate may be depressed by a pneumatic piston or an electro mechanical device.

FIGS. 8A-8E illustrate a label securing assembly. The label securing assembly may be used to secure a label prior to application to an article. In an implementation, a label securing assembly may include label receiving channels. Label receiving channels may also be referred to as slide channels. FIG. 8A depicts a cross section through receiving channel 160A as shown in FIG. 1. FIG. 8B depicts a side view of channel 160A. FIG. 8C is a top view, FIG. 8D is a side view, and FIG. 8E is a front view of channel 160A with a type of mounting tool. The receiving channels can be made from various materials. For example, the channels may be constructed from stainless steel, other metals, low friction plastic material, or other sturdy materials. The surface of a channel that comes in contact with an adhesive side of the label may be covered with a PTFE (polytetrafluoroethylene) coating, or other non-stick material.

As a label is removed from the backing material, the adhesive exposed label slides into the receiving channels and rests within the channels. The receiving channels are designed such that while the adhesive side of the label rests within the channels, the adhesive side does not cause the label to be affixed to parts of the channels. This is achieved by ensuring that minimal contact is made by the channels with the adhesive side of the label. One way to ensure minimal contact is by allowing only a small portion of the surface of the channels that come in contact with the adhesive side to contact the adhesive side of the labels. For example, as shown in FIG. 8A, the bottom surface 810 of receiving channel 160A includes a slightly upturned edge 812. As the label 111 gets separated from the backing material, an adhesive side 814 of label 111 slides along edge 812 of surface 810 of channel 160A. Thus, the entire surface 810 of the channel is prevented from coming in contact with adhesive side 814 of the label, preventing a significant portion of the label from being attached to the surface 810 of the channel. One end of edge 814 contacts label 111 at contact point 816, which is a minimal contact point with the adhesive side 814.

The receiving channel may include a surface that come in contact with the non-adhesive side of the label. This surface may be used to restrict a developed curvature of the label. For example, as shown in FIG. 8A, receiving channel 160A includes a top surface 820 that is adjacent to a non-adhesive side 815 of the label 111. The top surface 820 may be flat or any other shape, since it does not contact an adhesive side of the label and there is not a need for ensuring minimal contact with the label. Top surface 820 can restrict the label 111 from curling upwards by providing a barrier. Without the barrier provided by top surface 820, the label 111 may tend to curl upwards and get deformed prior to being applied on an article due to the inherent curvature the label may develop from being held on a roll. The narrow shape between the top and the bottom of the receiving channel holds the label in a nearly linear plane. The receiving channels may be positioned adjacent (e.g., parallel) to the peel assembly 120, as shown in FIG. 8B. In some examples, a portion 822 of the receiving channel that is located near the peel assembly 120 may be wider than the remaining portions of the receiving channel. For example, a side 824 of the top surface 820 of channel 160A may be bent upwards. Additionally, a side 826 of bottom surface 810 may be bent downwards. As a result, portion 822 may be wider than a portion 823 on the opposite side of the channel 160A. The purpose of making the portion near the peel assembly 120 wider is to ensure that there can be extra space for the label 111 at the entrance of the channel from the peel assembly as the label gets removed at the peel assembly from the strip 113. The extra space can be helpful if the label feeding motion causes the label to detour from an expected linear entrance and ensures that the label can be caught within the wider portion of the channel.

The inside vertical faces of the channel may be slightly wider than the label width to allow room for the label to fit inside the channels. In an example, vertical face 830 of channel 160A may be spaced approximately 1/16 inches wider on each side than the total label width. The general cross sectional profile of the receiving channels depicted in FIG. 8A may be effective for self-adhesive labels, such as the ones typically used in the industry. The cross sectional profiles and dimensions of the channels may be modified to achieve appropriate performance with labels of differing width and material stiffness. For example, modifications may include changing the width of the channels or distance between the upper and lower surfaces of the channels, or changing the cross sectional shape, etc. Further details regarding the receiving channels are described in FIGS. 9A-9D and FIGS. 10A-10G.

The receiving channels may be coupled with transfer assembly 150. In one embodiment, the receiving channels may be mounted on a bottom surface of transfer tray 151, as shown in FIG. 8B. In an example, the receiving channels may include mounting strip 840 on the top surface 820 of receiving channel 160A. Mounting strip 840 may provide a structure for the receiving channels to attach to the transfer tray. Mounting strip 840 may be made using a continuous solid or hollow piece of material (e.g., wood, plastic, metal). The mounting strips may be attached to the transfer tray 151 using studs 510 and/or bolts 516, as described in FIG. 5.

FIGS. 8C-8E depict another type of mounting tools attached to the receiving channels. In an example, receiving channel 160A may include a combination of all or some of mounting tools 851, 852, and 853. In some examples, mounting tools 851, 852, or 853 may be attached to the vertical face 830 of channel 160A.

Figure 9A:
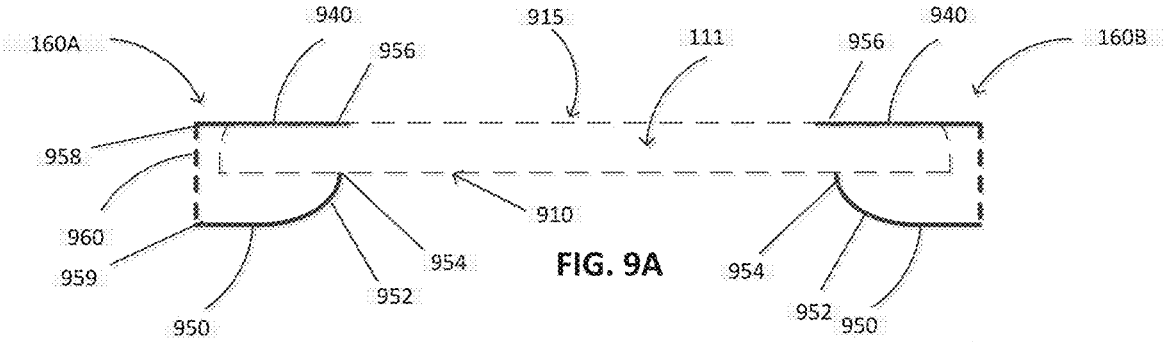
FIGS. 9A-9D illustrate various views of receiving channels, in accordance with some embodiments of the present disclosure.
Figure 9B:
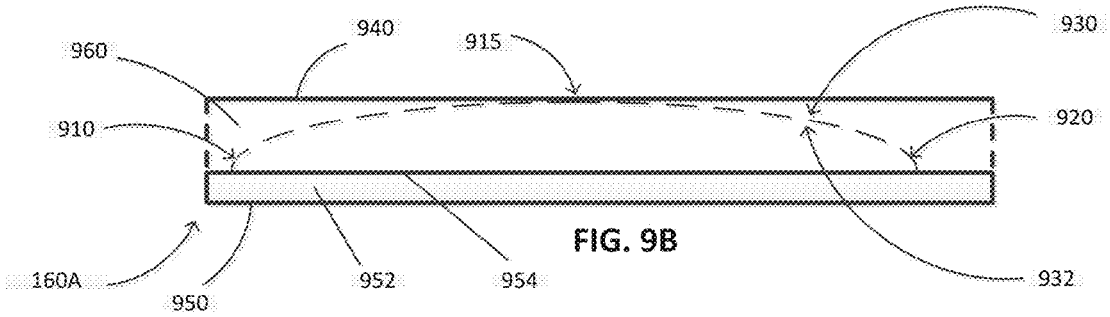
Figure 9C:
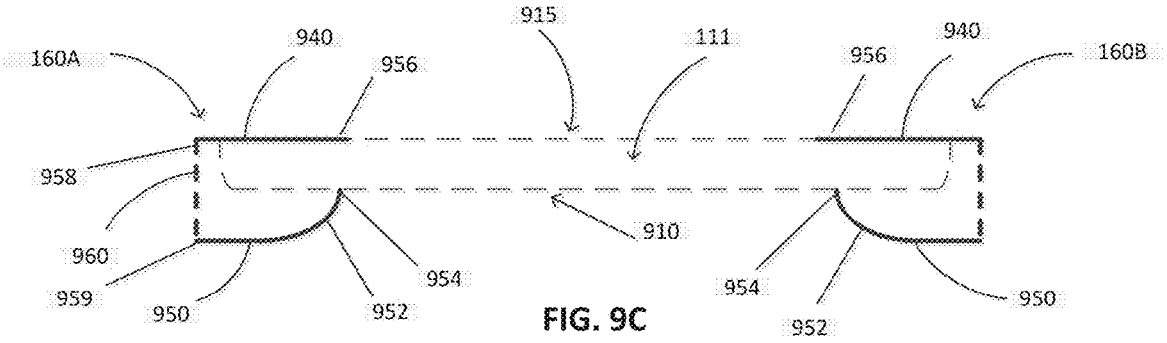
Figure 9D:
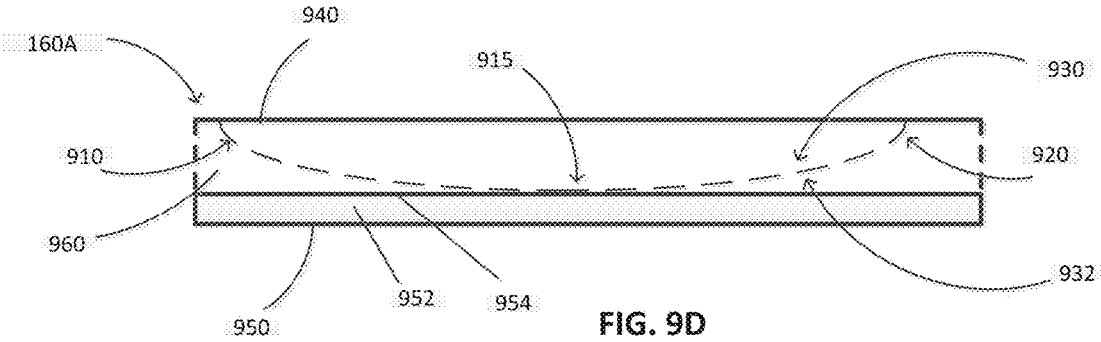

FIG. 9A-9D illustrates receiving channels for receiving a label in a label apparatus. FIGS. 9A and 9C each show a front view of a pair of receiving channels 160A and 160B. FIGS. 9B and 9D each show a side view of receiving channel 160A. In FIGS. 9A and 9B, receiving channels are depicted as holding label 111 with an intrinsic curvature, where label 111 starting at an end portion 910 curves (e.g., bends) upwards towards a middle portion 915 of label 111 and curves down towards an end portion 920. In other words, label 111 has an upward curvature at middle portion 915 as compared to end portion 910 and 920. In FIGS. 9C and 9D, receiving channels are depicted as holding label 111 with an intrinsic curvature, where label 111 starting at an end portion 910 curves (e.g., bends) downwards towards a middle portion 915 of label 111 and curves up towards an end portion 920. In other words, label 111 has a downward curvature at middle portion 915 as compared to end portion 910 and 920. In each set of figures, label 111 is depicted as having a non-adhesive side 930 and an exposed adhesive side 932. In some examples, the label may curve in a sinusoidal shape. For example, this may happen with long labels.

FIGS. 9A and 9C illustrate a first channel 160A and a second channel 160B. Each of the first channel 160A and second channel 160B may include a first surface 940 and a second surface 950. Second surface 950 may be positioned opposite, or generally parallel, to first surface 940. In one example, first surface 940 may be substantially flat or planar. In another example, first surface 940 may be curved, angled, or another shape suitable to provide a support to label 111. First surface 940 may be adapted to restrict or limit the intrinsic curvature of the label 111. In one example, the curvature being restricted may be an upward curvature of the middle portion 915 of label 111 contacting first surface 940, as shown in FIG. 9B. In another example, the curvature being restricted may be an upward curvature of the end portions 910 and 920 of label 111 contacting first surface 940, as shown in FIG. 9D. First surface 940 may restrict the label 111 from curling downwards (in FIG. 9A-9B) or upwards (in FIG. 9C-9D) in a spherical or nearly spherical shape. The restriction is achieved due to a barrier or support provided by the first surface, in conjunction with the second surface opposite to the first surface, such that the natural tendency to curl due to the inherent curvature is restricted by the barrier. The curling can otherwise cause challenges during application of the label onto an article, for example, causing the label to be disintegrated or deformed, causing the label to be incorrectly applied in a curled state, causing the end portions of the label to get affixed to each other, etc. Thus, the first surface 940 of the first and second channels may be provided to limit the curvature so that the label may be applied appropriately.

In one embodiment, second surface 950 may include a curved edge 952. Curved edge 952 may include one open end 954 (e.g., a free edge) that is not attached to any other elements. Open end 954 may be a sharp end. Open end 954 may be curved towards the direction of the first surface 940. In other words, curved edge 952, including open end 954, may be curved inwards towards within the channels. As a result, only the open end 954 may come in contact with adhesive side 932 of label 111. Since second surface 950 has edge 952 that curves inwards, portions of second surface 950 other than open end 954 are prevented to come in contact with portions of label 111. This provides for a minimal contact surface area with label 111. Thus, second surface 950 may be provided so that the open end 954 of the second surface of each of the first channel and the second channel are adapted to contact an adhesive side 932 of label 111 to hold the label by the adhesive side and restrain the label within the channels. In addition, a label that has a natural curvature may also come in contact with the channels in few portions of the label, for example, at end portion 910 and end portion 920 as shown in FIG. 9B, and at middle portion 915 as shown in FIG. 9D. This may also limit the number of contact points where the label contacts the adhesive side.

In one embodiment, first channel and second channel may also each include a vertical face 960. Vertical face 960 may connect first surface 940 to second surface 950. In an example, vertical face 960 may connect an end 958 of first surface 940 to an end 959 of second surface 950. End 959 may be situated on the opposite side from end 954. In another example, vertical face 960 may connect the two surfaces at other locations within the surfaces. In some embodiment, vertical face 960 may be a continuous and solid plate. In that scenario, the vertical face 960 may be used to restrict the label sideways. That is label 111 may not slide out of the channels due to the barrier provided by vertical face 960. In other embodiments, vertical face 960 may be a hollow structure, such as that made of pieces of wire. In such a scenario, vertical face 960 may be used to hold the first and second surface together in place.

In some embodiments, first channel 160A and second channel 160B may be separated from each other. The channels maybe positioned parallel to each other in order to hold the label on a linear or flat plane. In such a configuration, the gap between the two channels may accommodate a label applicator assembly that can come in contact with the non-adhesive side 930 of label 111. The gap may allow for different types of label applicators and allow for manipulation of the label application in different ways. In some embodiments, first surface 940 of each of the channels may be connected to each other, making the first surface one continuous first surface. The first surface of each channel may be connected to each other on end 956. The orientation of receiving channels may not be limited to those depicted in FIGS. 9A-9D. For example, the receiving channels depicted in FIGS. 9A-9D may be rotated in any direction and orientation and applicable for the labeling needs. The receiving channels may be rotated 90 degreed (sideways), 180 degrees (flipped upside down), or in any other measurement necessary.

The receiving channels may also include various other shapes. The characteristics that are to be preserved in the various shapes of each channel include two elements positioned opposite each other that can hold a label within the cavity created by the two elements and restrict a curvature of a label with a natural curve inside the two elements. Additionally, one of the elements is to contact the adhesive side of a self-adhesive label with minimal contact surface. Various embodiments of the channels are depicted in FIGS. 10A-10G. However, the channels are not limited to these embodiments. For example, FIG. 10A depicts a second surface with a curved edge 952 curved towards first surface and away from vertical face 960, as described in FIGS. 9A-9D. In FIG. 10 a second surface with a curved edge 952 is depicted to be curved towards first surface and towards the vertical face 960. FIG. 10C shows a channel where the second surface is angled towards the first surface at end 959, adjacent to the vertical face 960. FIG. 10D shows that edge 952 of the second surface is angled at a portion 953 starting from a straight second surface. The open end 956 may be away from (solid line) or towards (dashed line) the vertical face 960. FIG. 10E shows that the angle between second surface 950 and the edge 952 is at a right angle. FIG. 10F shows a perspective view of a channel where a first surface 940 is positioned across a wire 1070, the wire 1070 being connected to the first surface 940 on one side of the channel at portion 1071, and having an open side for the label to enter in the direction 1073. FIG. 10G has a similar configuration as FIG. 10F, but is attached to a different portion 1072 of the first surface. The label may enter in the direction 1074. Each of these embodiments provide for a first element and a second element across each other for restricting a curvature of the label, and a second element that provides for minimal contact with an adhesive side of the label.

Figure 11:
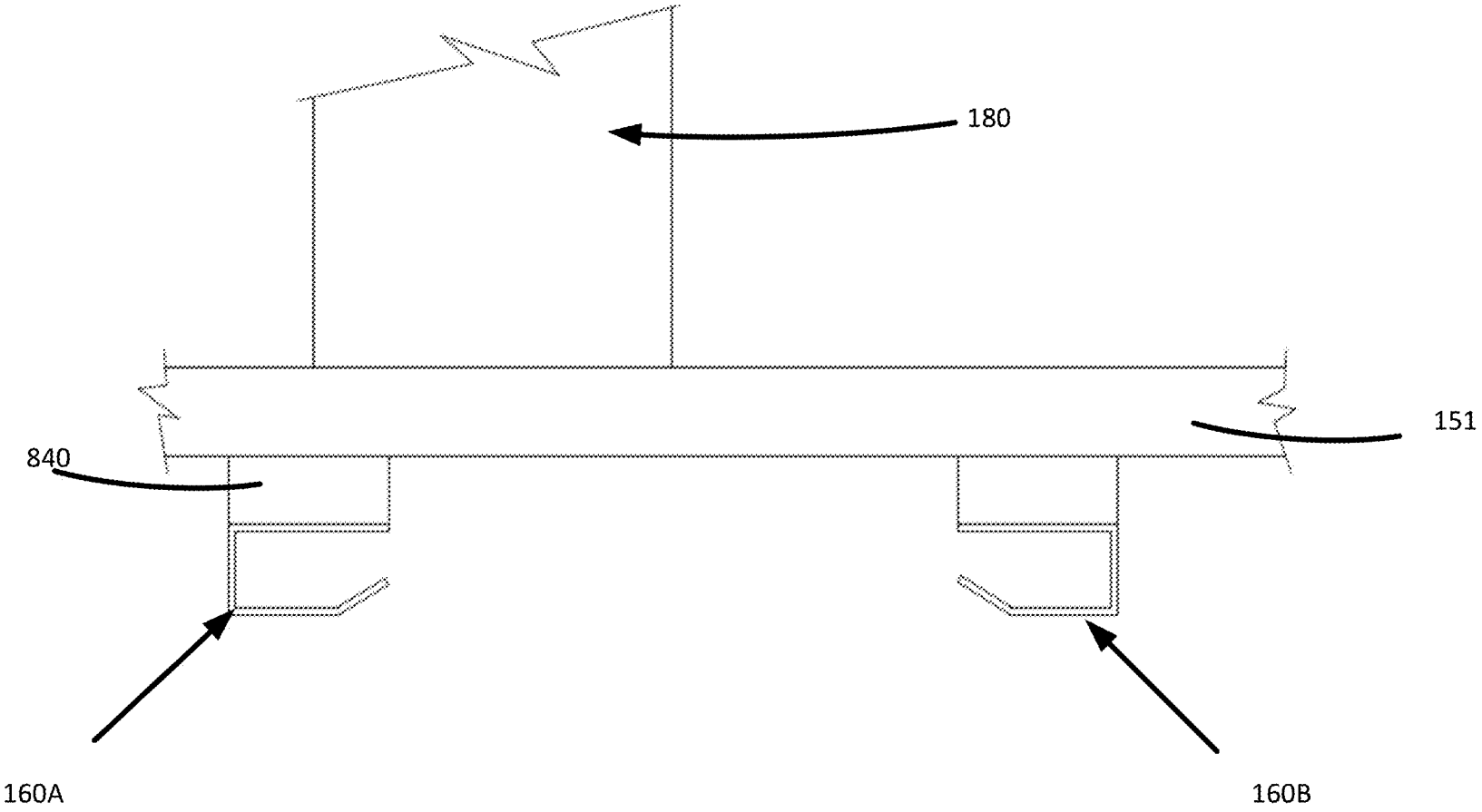
FIG. 11 illustrates a pair of receiving channels, in accordance with some embodiments of the present disclosure.

FIG. 11 depicts a label apparatus with receiving channels 160A and 160B, a mounting strip 840, a receiving tray 151, and an tamp assembly 180, as described in previous Figures. The channels are configured similar to the configuration of FIGS. 9A-9B.

Figure 12A:
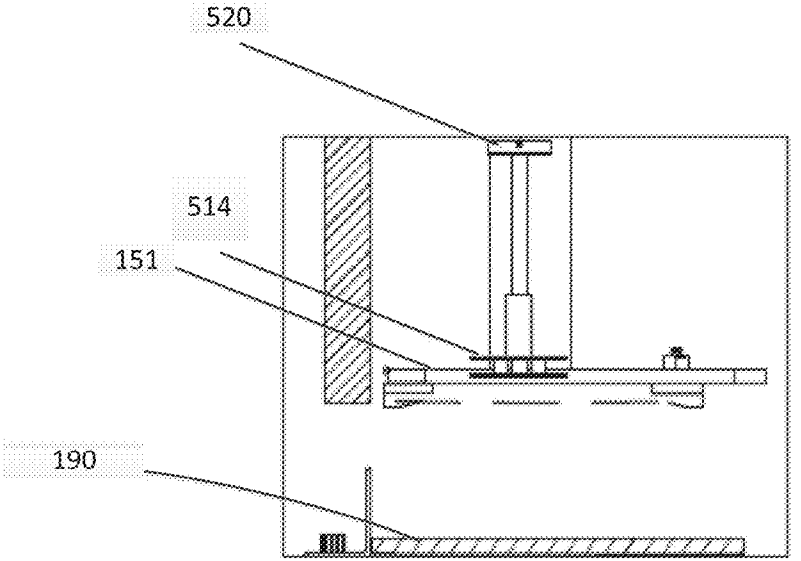
FIGS. 12A-12C each illustrates a front view of a transfer tray during three stages of label application, in accordance with some embodiments of the present disclosure.
Figure 12B:
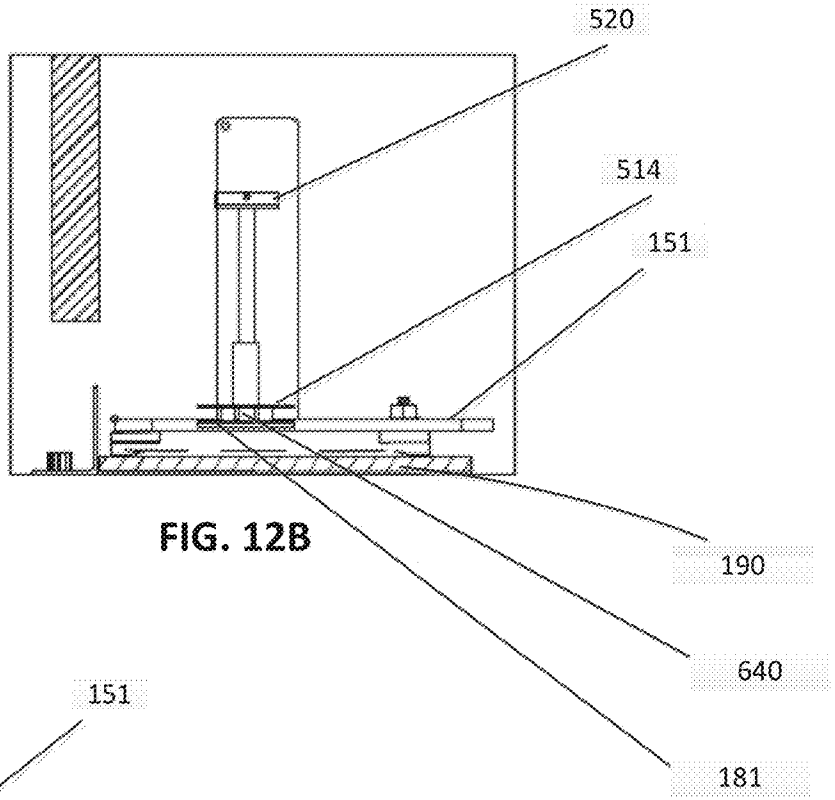
Figure 12C:
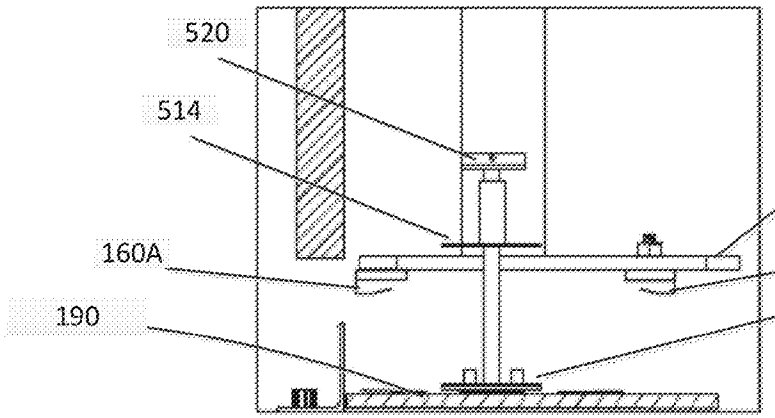

FIGS. 12A-12C each illustrates a front view of transfer tray 151 during three stages of label application. FIG. 12A shows the transfer tray 151 when it is in the label receiving position. When the operator applies downward pressure on the tamp plate bar 520, the transfer tray 151 moves down until it reaches the labeler floor 102 or if there is an article, then when it reached the article. This position is shown in FIG. 12B. At this point, additional downward pressure on the tamp plate bar 520 causes the magnet 640 on the tamp plate 181 to release from the tamp plate positioning bar 514. The release of the magnet 640 that was pulling on the tamp plate positioning bar 514 causes the transfer tray 151 to travel back up to the label receiving position through the action of the extension springs (not shown). Since the tamp plate 181 is still being held down, the label is restrained from being carried up with the transfer tray 151 along with channels 160A and 160B. The label edges slide out of the receiving channels as the tray 151 rises up. The tamp plate 181, with the label under it, continues traveling down a short distance until the label makes contact with the article 190 being labeled. This position is shown in FIG. 12C. The pressure from the plate 181 affixes the label to the article 190. The operator then releases the tamp plate bar 520 and the tamp plate 181 rises up to the label receiving position due to the action of extension springs attached to it (not shown). The magnet 640 then reconnects the tamp plate 181 to the tamp plate positioning bar 514.

Figure 13:
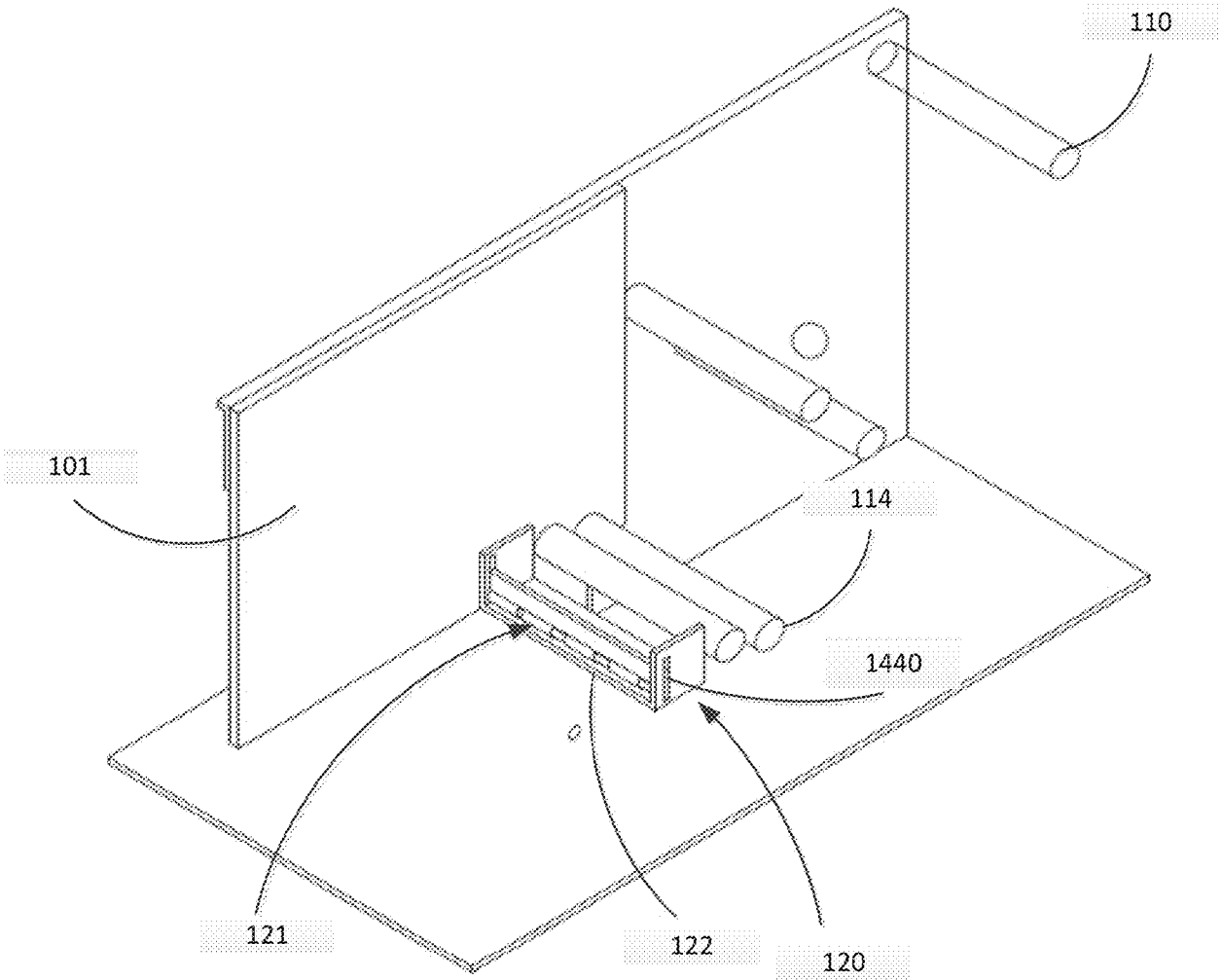

FIG. 13 illustrates a perspective view of a label apparatus with a peel assembly 120. FIG. 14A shows a top view of the peel assembly 120. FIG. 14B shows a side view of the peel assembly 120, when looking towards the mounting panel 101 with the mounting panel 101 in the background. FIG. 14C shows a side view of the peel assembly 120, when looking away from the mounting panel 101 with a side 1402 of peel assembly 120 in the background. FIG. 14D shows a front view of peel assembly 120. As discussed previously, the peel assembly may be used to remove labels from backing material they are attached to.

In FIG. 13, a peel assembly 120 is shown to be attached to mounting panel 101. Peel assembly 120 may include a peel bar 122 and a roller 121. Roller 121 may also be known as a pressure bar. A strip 113 (As described in FIG. 1) may be fed between roller 121 and peel bar 122. FIGS. 14A-14D shows peel assembly 120 with a side 1401 and a side 1402 (see FIG. 14D). Each side 1401 and 1402 may each include a slot 1440. Roller 121 of peel assembly 120 may include a press plate 1410. Press plate 1410 may be mounted movably within slot 1440. Slot 1440 may be a cavity or a hole within sides 1401 and 1402 designed to accommodate ends of press plate 1410. Press plate 1410 may be moved up and down within slot 1440. The press plate 1410 may be moved up and down to accommodate labels of different dimensions, such as, of different thickness. Press plate 1410 may include a groove 1430 across the press plate 1410. Rings 1420 may be coupled at the groove 1430. Rings 1420 may be positioned such that the rings may slide side to side in order to be moved away from the outside edges of the label. The outside edges may accumulate extra adhesive that can come in contact with rings 1420 if the rings are in contact with the outside edges. The option to slide may be useful to accommodate labels of different width. Rings 1420 may be made out of plastic. When a label is not fed through the peel assembly 120, bottom portions of rings 1420 may rest on peel bar 122. Rings may be used to provide a smooth surface to apply pressure on the label with, such that the non-adhesive side (e.g., the side with the label text, prints, etc.) does not get disintegrating by coming in contact with roller 121.

As discussed previously, an intrinsic curvature develops on the label as a result of being stored on a roll and may cause the label to curl at a free state. When majority of the label is removed from the backing material, the remaining portion of the label tends to detach from the backing material automatically, even prior to reaching the sharp edge of the peel bar. If a portion of the label curls and exposes the adhesive side before entering the transfer assembly, the label may get adhered to an external element of the apparatus, may not be able to enter the transfer assembly, or enter the transfer assembly in a deformed shape. As label 111 continues to move within transfer assembly 150 from peel assembly 120, roller 121 (e.g., a bottom portion of rings 1430) positioned above peel bar 122 may provide a downward pressure on the top surface of label 111. The pressure applied by roller 121 keeps the portion of the label 111 between peel bar 122 and roller 121 secured to backing material 116. The purpose is to keep the portion of the label that is passing through the peel assembly, which is still outside of the transfer assembly 150, attached to the backing material 116 until the last edge of the label passes through peel assembly 150. As a result, an external pressure helps maintain an adhesive bond between the label and the backing paper as close as possible to the point where the backing paper bends under the peel bar 122 and the label separates from it, preventing the last portion of the label from detaching and curling prior to entering the transfer assembly.

Figure 15A:
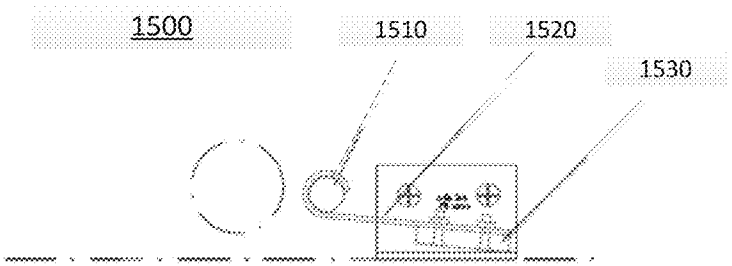
FIGS. 15A-15C illustrate another peel assembly, in accordance with some embodiments of the present disclosure.
Figure 15C:
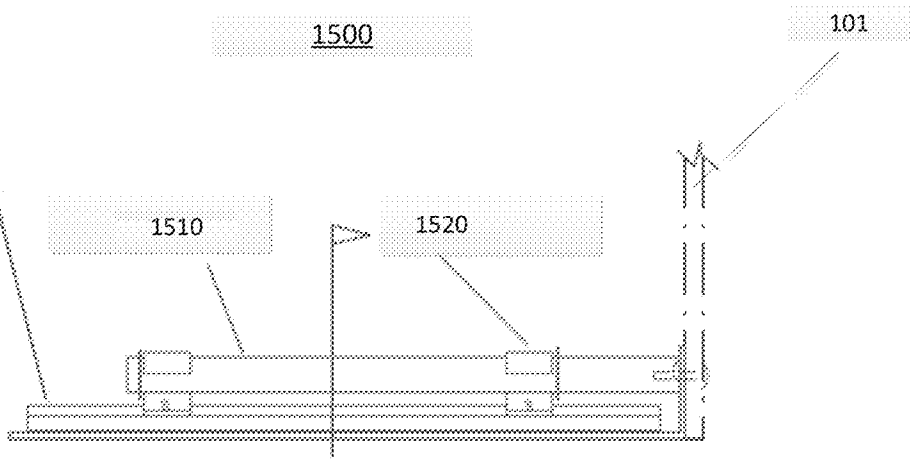
Figure 15B:
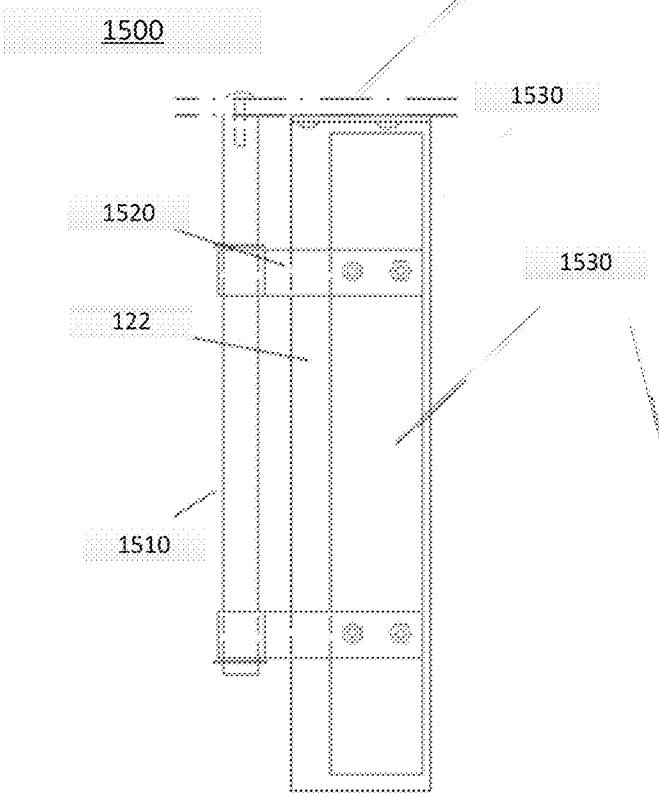

FIGS. 15A-15C illustrate another embodiment of a peel assembly. FIG. 15A shows a side view, FIG. 15B shows a top view, and FIG. 15C shows a front view of a peel bar assembly 1500. Peel assembly 1500 may include a hinge rod 1510, a hinge bar 1520, a press plate 1530, and a peel bar 122. Hinge rod 1510 may be mounted on mounting panel 101. One end of hinge bar 1520 may be wrapped around hinge rod 1510. The opposite end of hinge bar 1520 may be attached press plate 1530. The press plate 1530 may rotate on the hinge rod 1510 and a torsion spring on the hinge rod, or gravity from the weight of the press plate, can produce a slight downward pressure on the tip of the press plate where it contacts a label. The pressure applied by press plate 1530 helps maintain an adhesive bond between the label and the backing paper. Without the pressure, a label could potentially pop off the backing paper before being fully separated at the peel bar tip, as described above.

Figure 16B:
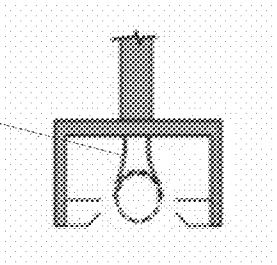
FIGS. 16A-16D illustrate various types of articles that may be labeled using the label apparatus in accordance with some embodiments of the present disclosure.
Figure 16A:
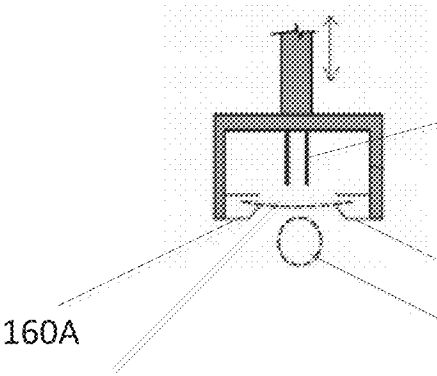

FIGS. 16A-16D shows various types of articles that may be labeled using the label apparatus disclosed herein. FIGS. 16A and 16B shows the channels being used for applying labels on cylindrical objects, such as, pipes, cables, bottles, etc. Since there is no suction plate to hold onto the label by its non-adhesive side, the space above can be used to apply the labels using applicators suitable for these types of shapes of objects. In an example, the applicator assembly may include a pair of label press strips 1610. As shown in FIG. 16B, the receiving channels 160A and 160B, with label 111, may be lowered onto pipe 1620. The pipe 1620 may push the label 111 up as it contacts the label 111. The pair of strips 1610 may go around the pipe 1620 as the pipe rises up, attaching the label to the curved surface of the pipe. If the label needs to wrap completely around the pipe, a second set of strips or rollers can be used to press the label onto the lower half of the pipe.

Figure 16D:
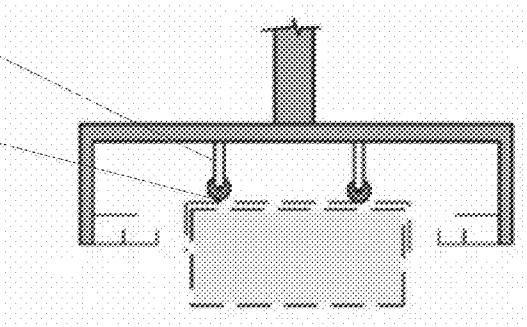
Figure 16C:
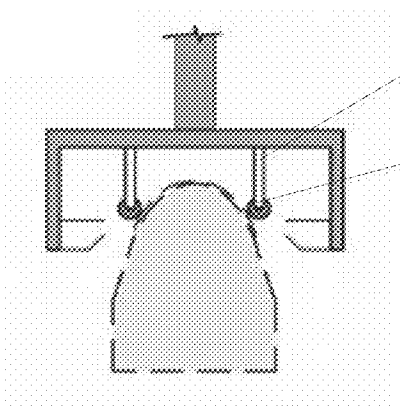

FIGS. 16C and 16D shows the channels being used for applying labels on dome shaped objects and boxes, respectively. In an example, as shown in FIGS. 16C and 16D, the applicator assembly may include rollers 1650 attached to strips 1610. The strips may be used similar to those discussed in FIGS. 16A and 16B. Additionally, rollers 1650 may be controlled by servo motors (not shown) to apply the labels. The rollers may provide extra pressure on the objects to control the application of the label on an uneven surface, or to continue to apply the label on multiple surfaces, such as when applying the label on top and side surfaces of a box as in FIG. 16D.

Figure 17:
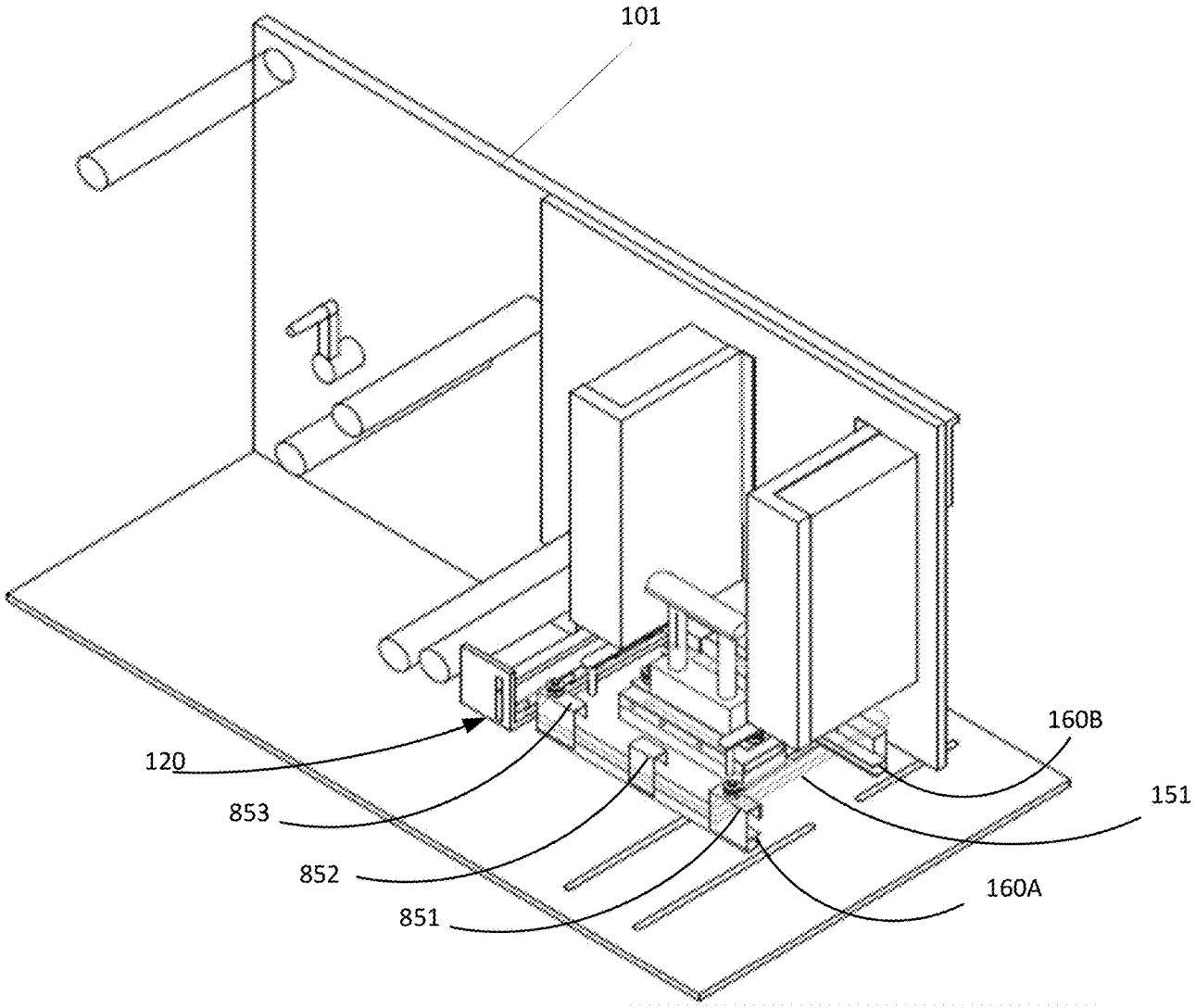
FIG. 17 illustrates a perspective view of an example apparatus for applying a label on an article in accordance with some embodiments of the present disclosure.

FIG. 17 illustrates a label apparatus 100 without a roll of labels mounted on the apparatus. A peel assembly 120 as shown in FIGS. 14A-14D is depicted in FIG. 17. FIG. 17 also includes receiving channels 160A and 160B attached to mounting tools 851-853 as shown in FIGS. 8C-8E. As depicted, a receiving tray 151 may be accommodated within the mounting tools 851-853.

Figure 18:
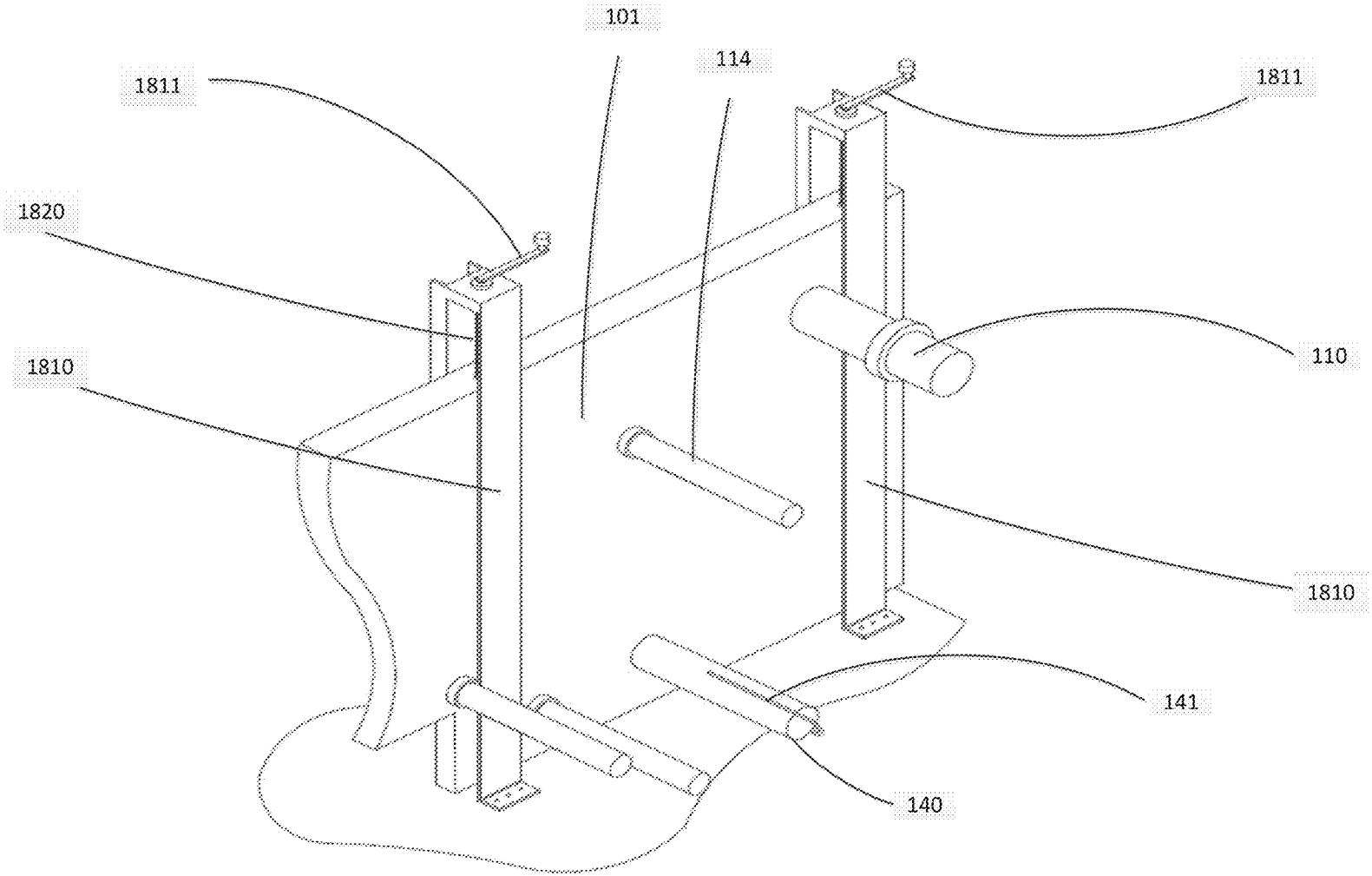
FIG. 18 illustrates a mounting assembly, in accordance with some embodiments of the present disclosure.

FIG. 18 illustrates one embodiment of a mounting assembly of apparatus 100. The thickness of articles which can be accommodated by the labeler may be limited by the distance between the transfer tray 151 and the labeler floor 102. FIG. 18 shows a configuration that may allow this distance to be varied by using an adjustable mounting panel (e.g., a moveable mounting plate) so that articles of different thicknesses could be labeled. This may be achieved by mounting the labeler mounting panel 101 on a guide rail system 1810 that can be raised and lowered with a hand turned screw crank 1811 or a similar mechanical device to screw or unscrew a screw 1820.

FIG. 19A shows a front view of a fixed mounting plate 1910. FIG. 19B shows a front view of a moveable mounting plate 1920. As seen from FIG. 19B, moveable mounting plate 1920 may be moved to a raised position away from floor plate 102. FIG. 19C shows a configuration that may use a combination of a a fixed mounting plate 1910 and a moveable mounting plate 1920 in the same apparatus. This may allow for some elements of the apparatus on the fixed mounting plate to remain in a fixed position while other elements on the moveable mounting plate may be adjustable.

Figure 20C:
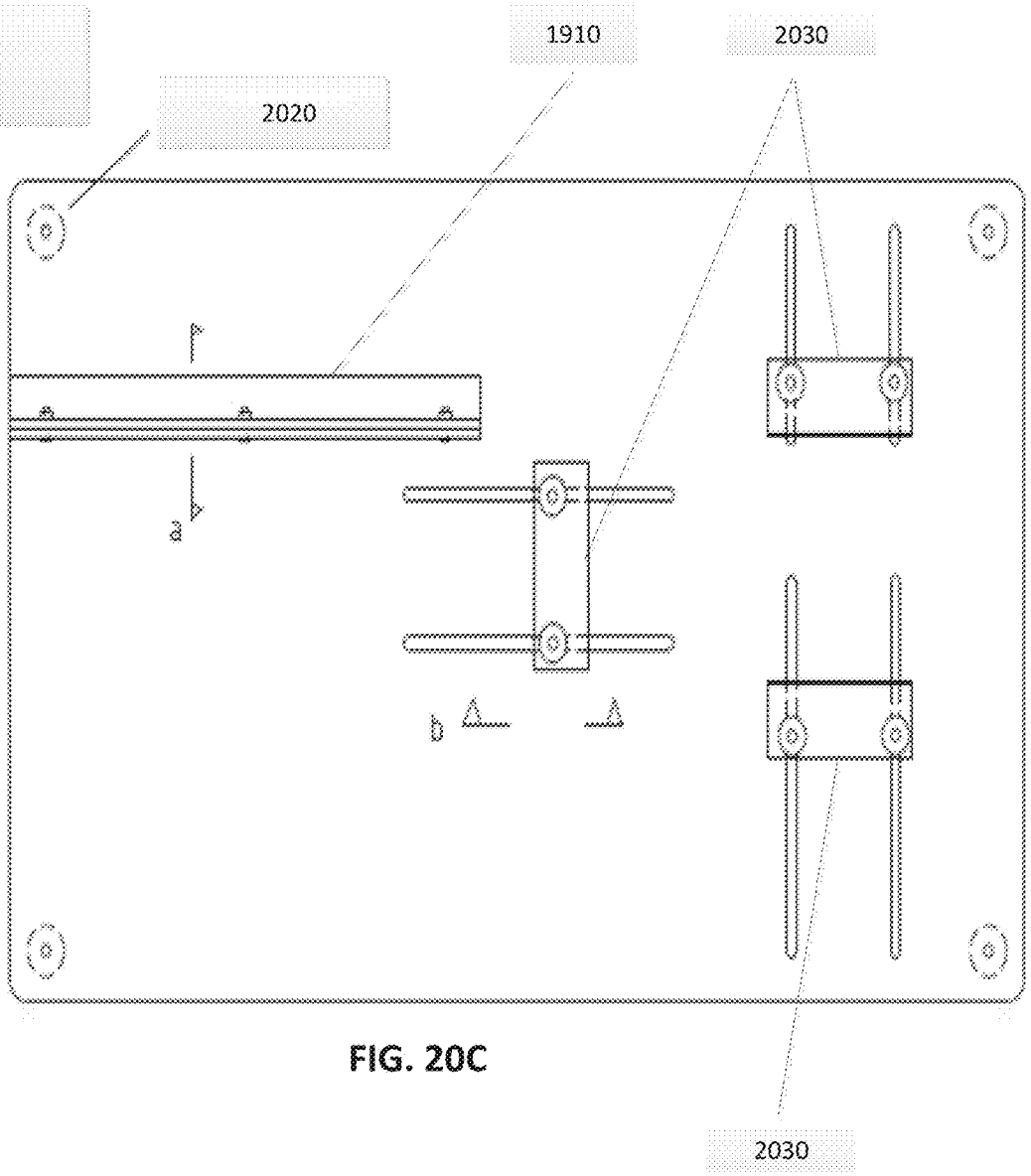
Figure 20A:
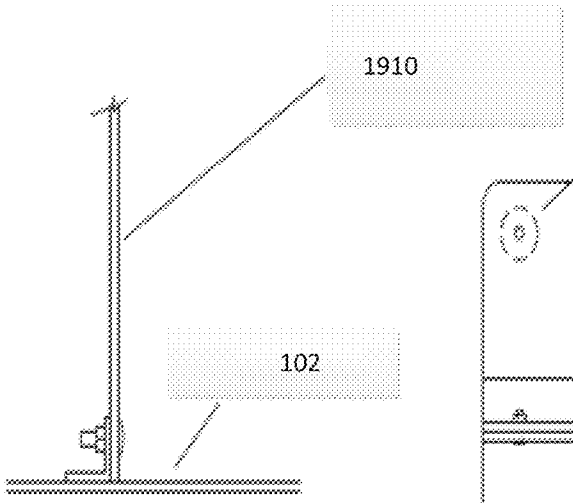
Figure 20B:
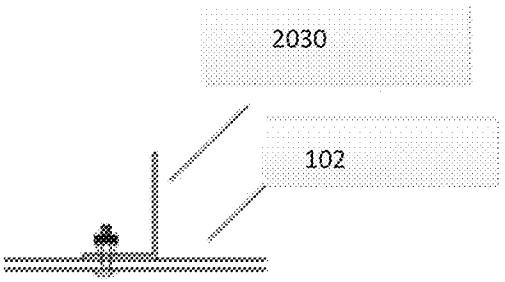

FIG. 20A shows a front view of a fixed mounting plate 1910. FIG. 20B shows a guide for article to be labeled. FIG. 20C shows a top view of the apparatus. An article 190 being labeled maybe located under the transfer tray on the labeler floor plate 102. Adjustable guides 2030 located on the floor plate 102 of the labeler slide in tracks 105 (shown in FIG. 1). The guides may be used to accurately position the article 190 for label application. Guides 2030 may be same or similar to guides 104 shown in FIG. 1. Rubber feet 2020 may be used on the floor panel 102 to keep the apparatus grounded.

Figure 21A:
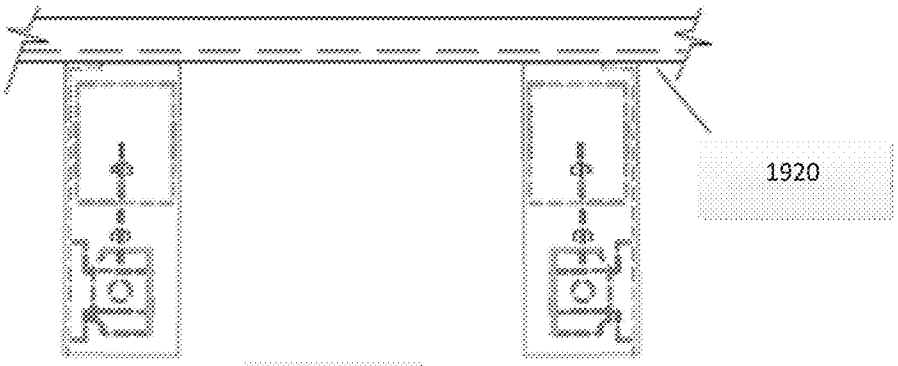
FIGS. 21A-21C illustrate various views of a label apparatus including slide bearings, in accordance with some embodiments of the present disclosure.
Figure 21C:
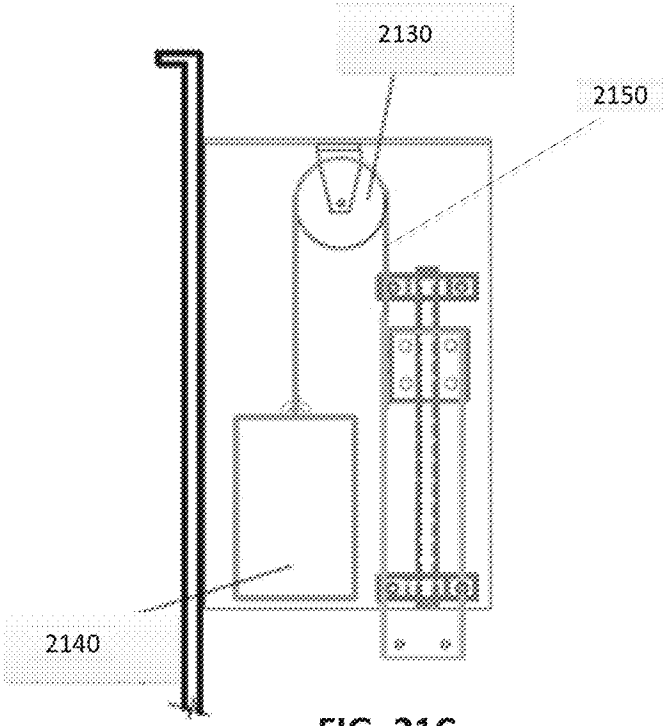
Figure 21B:
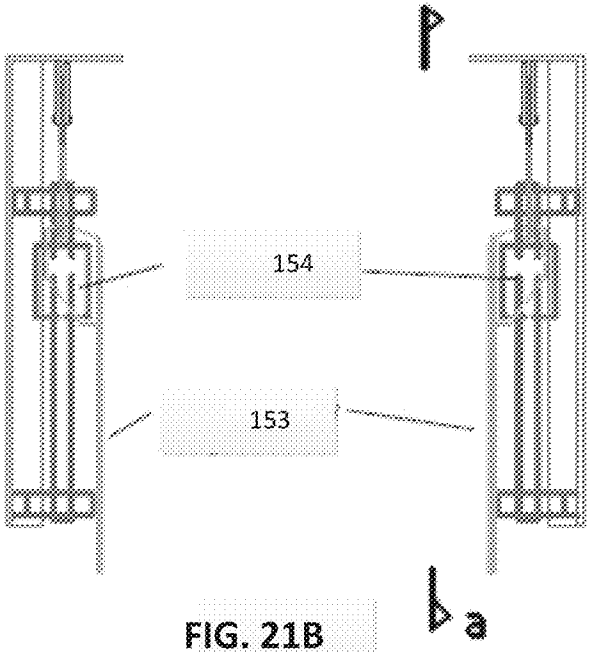

FIG. 21A shows a top view of the label apparatus showing the slide bearings 154, including moveable mounting plate 1920. FIG. 21B shows a side view of the label apparatus showing the slide bearings, where a receiving tray hanger 2110 is attached to the slide bearings 154. FIG. 21C shows a front view of the label apparatus showing the slide bearings, where a pulley 2130 is used. On one side of pulley 2130 may be attached a slide bearing counter weight 2140, while on the other side of the pulley 2130 may be attached the slide bearings 154, connected and balanced through a string 2150.

Figure 22:
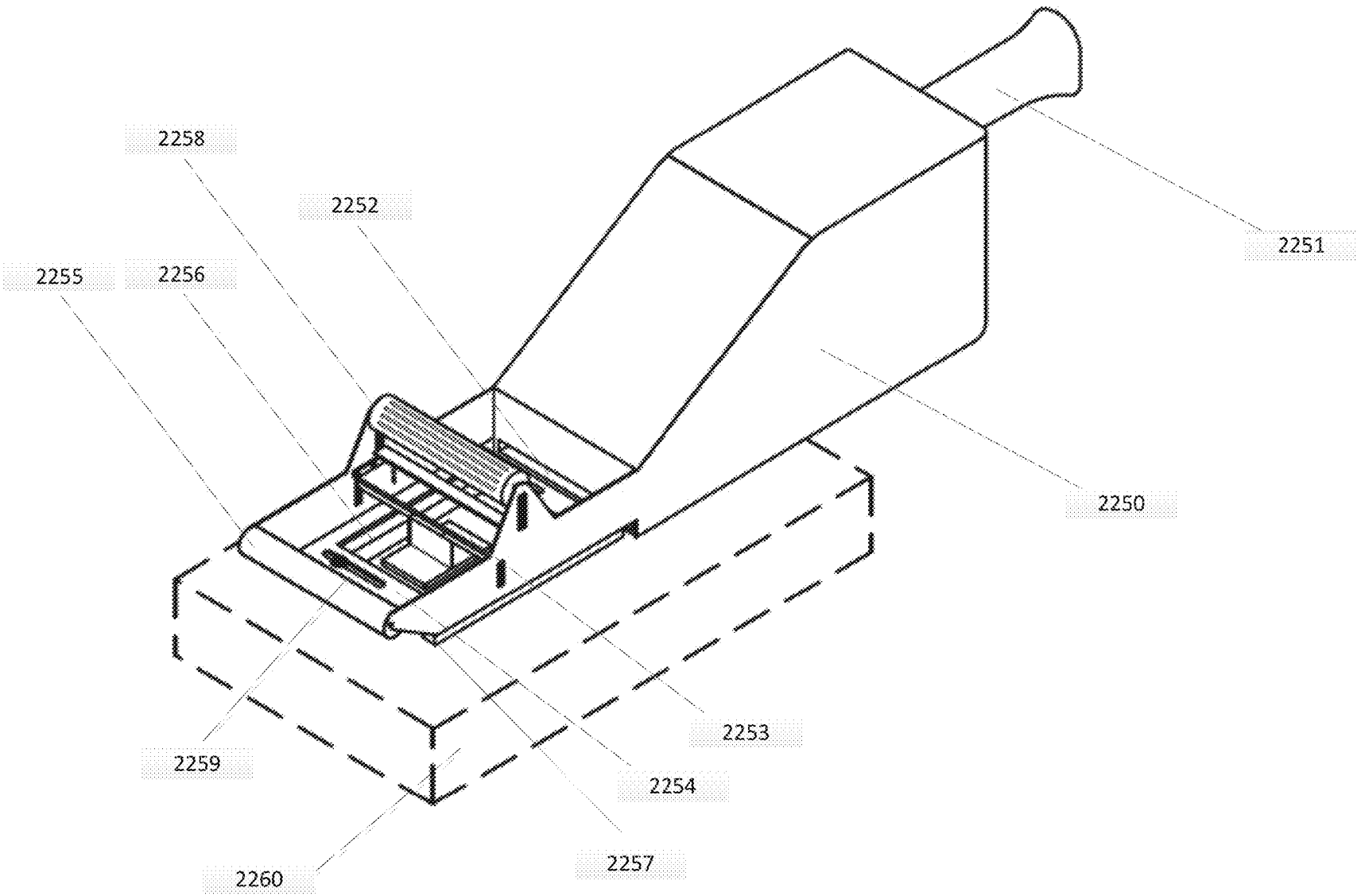
FIG. 22 illustrate a hand held label apparatus, in accordance with some embodiments of the present disclosure.

FIG. 22 illustrates an embodiment of label apparatus 2200 that may represent a hand held version. The hand held labeler housing 2250 may hold the roll of labels and a battery powered electric motor (not shown) for winding the label backing paper on a winding spool. As the backing paper is wound, labels may be separated at the peel bar 2252. As labels pass over the peel bar 2252, the labels may slide along the receiving channels 2257 that may be positioned under a transfer tray 2254. One of the receiving channels 2256 may be mounted with a threaded rod that can be positioned along an elongated hole 2259 in the transfer tray. By adjusting the position of the receiving channel on the transfer tray, labels of varying width can be accommodated. In an implementation, the non-adhesive contacting surfaces of each of the channels may be connected to each other.

The electric motor within the apparatus may be controlled by a light sensor that detects the gap between labels and stops the motor when a label is fully ejected onto the transfer tray. A trigger on the machine handle 2251 may be used to start the motor again after applying a label. With this hand held version of the labeler, the transfer plate can be held directly on top of an article 2260 to be labeled. A small downward movement of the tamp plate 2253 is may be necessary to affix the label to the article 2260. This motion can be accomplished by applying downward pressure to a spring loaded handle 2258 on the front of the labeler. Alternatively, a twisting motion of the handle 2251 may be mechanically converted into a similar downward movement. A roller 2255 on the front of the labeler would then be used to roll over the label and completely affix it. The labeler is especially suitable for applying longer labels because the operator does not need to move the labeler in coordination with a label, as it is being ejected from the labeler body. Since the label may be fully detached and secured within the channels before being affixed, the labeler needs to be only held over the desired label location and then the handle is squeezed to apply it.

Figure 23A:
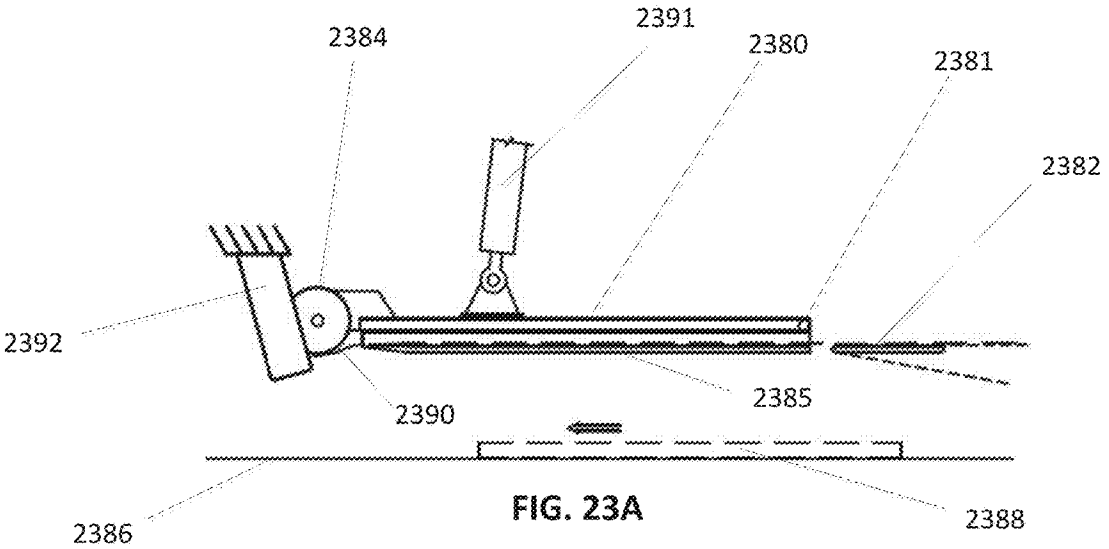
FIGS. 23A-23B illustrate an automatic label apparatus, in accordance with some embodiments of the present disclosure.
Figure 23B:
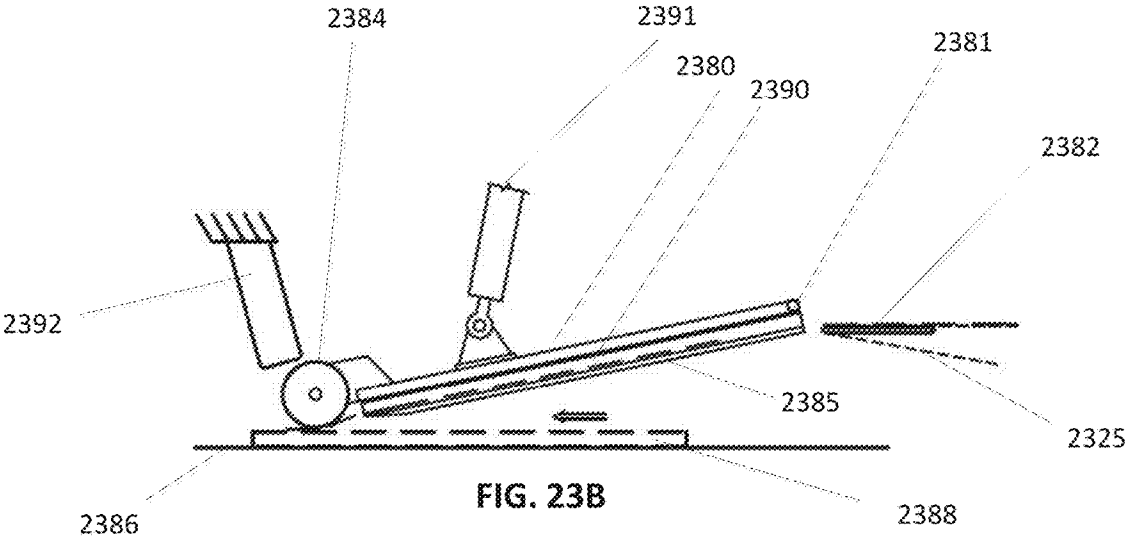

FIG. 23A-23B shows an embodiment of the label apparatus representing an automated version of the apparatus. In an automated version of the labeler, a micro-controller may be used to identify when the transfer tray is empty and to start the motor to advance another label. A conveyor may place articles under the transfer tray for labeling. The conveyor may stop when articles are positioned for labeling. At that point the micro-controller may activate a pneumatic or motor driven piston to lower the transfer tray and apply the label to the article with the tamp plate. Once the label is applied, the tamp plate may be raised back up to the label receiving position. A new label may then be fed into the transfer tray and the conveyor belt may forward a new article for labeling. A roller or wiper brush located downstream from the labeler can roll or wipe the label to completely adhere it.

FIGS. 23A and 23B each show a side view of the transfer tray in two label application positions. In this embodiment, labels are applied to articles on a continuously moving conveyor belt or other form of transport. FIG. 7A shows the transfer tray 2380 in the label receiving position. Labels 2390 may be separated from the backing paper 2325 at the peel bar 2382. The labels 2390 may then slide into the receiving channels 2385. The receiving channels 2385 may be slightly shorter than the label so the leading edge of the label may project from the end of the receiving channel 2385 when the label is fully detached from the backing paper. The receiving channels 2385 may be mounted on the underside of the transfer tray 2380. The transfer tray 2380 may be supported so that it can rotate about a pivot point 2381 located adjacent to the peel bar 2382. A label roller 2384 and label stop bar 2392 may be located at the end of the transfer tray 2380. The leading edge of the label, which may project beyond the receiving channels, slides under the label roller 2384. The label stop bar prevents the label from sliding beyond its desired position due to momentum or other factors.

As an article 2388 travels by on a conveyor belt 2386, a micro-controller signal may cause a pneumatic piston 2391 to rotate the transfer tray 2380 down until the roller 2384 with a label 2390 under it contacts the article 2388. This label applying position is shown in FIG. 23B. As the article with the label attached to it continues moving on the conveyor belt, the remainder of the label may be pulled off the transfer tray 2380 and applied to the article. After the label is applied, a micro-controller signal may cause the transfer tray 2380 to rotate back to the label receiving position to complete a label application cycle. Because the label is being pulled out of the receiving channels instead of being applied directly off the peel bar, here is no need to carefully match the conveyor and label strip speeds. Such would be required with traditional wipe-on labelers.

Additional uses of the channels may be apparent to one skilled in the art. For example, a modified wipe on method may be used in combination with using the receiving channels. For example, the length of the receiving channels may be kept shorter than the length of the label that is to be used in the modified wipe-on method. In that scenario, a label exposing adhesive on the leading edge of the label may protrude outside out the receiving channels. An object, such as a bottle, may be placed under the protruding label. The bottle may be then rotated away from the channels such that the label gets affixed to the bottle and surrounds the bottle when the bottle is rotated. The modified wipe-on method can be used with many other objects (e.g., deli packages, uneven shapes) and within different configuration (e.g., hand held, tabletop, etc.) of the apparatus. Since there is a label securing assembly holding the label in place, there is no need to carefully match the motion of the object to a motion of the label peeling. The peeling and application of the label can take place independent of each other. In an implementation, once the label rests on the channels, the label may be appended on the article by applying pressure on the label against the article. A first portion of the label protruding outside of the label securing assembly may be appended on the article by applying pressure on the first portion of the label against the article. A remaining portion of the label may be extracted from the label securing assembly by pulling the article with the attached label away from the label securing assembly. As the article is pulled, the remainder of the label becomes attached to it. The remaining portion of the label may be appended on the article by applying pressure on the remaining portion of the label against the article.

Figure 24:
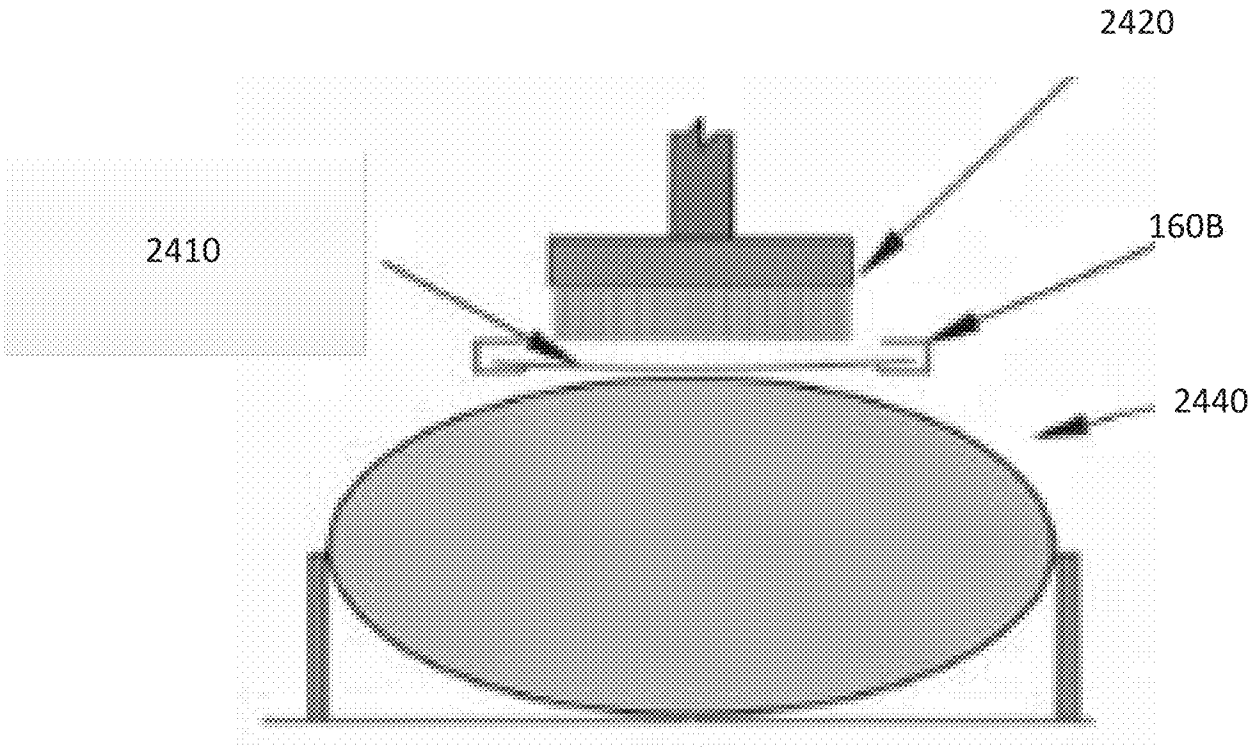
FIG. 24 illustrates a label apparatus with a brush applicator in accordance with some aspects of the current disclosure.

FIG. 24 illustrates a label apparatus with a brush applicator in accordance with some aspects of the current disclosure. An advantage of the label apparatus in the current disclosure includes that the applicator assembly does not need to use suction to hold on to a label. Thus, a number of different types of applicators may be used. A brush can be used to apply labels to non-flat or delicate surfaces. In traditional label applicators, a foam pad is sometimes used because suction can be transferred through holes in a foam pad. However, brush can provide better control and versatility than a foam pad. The length and stiffness of brush bristles can be selected to vary effectively to press a label onto an oval or even cylindrical object. Softer bristles can be used for delicate items and/or uneven surfaces. As shown in FIG. 24, a brush faced tamp plate 2420 may be used as part of an applicator assembly. The brush faced tamp plate 2420 may be accommodated within the cavity created by the channels 160A and 160B. An oval bottle 2440 is shown as the article being labeled using the brush applicator to apply label 2410 resting on channels 160A-B.

Figure 25:
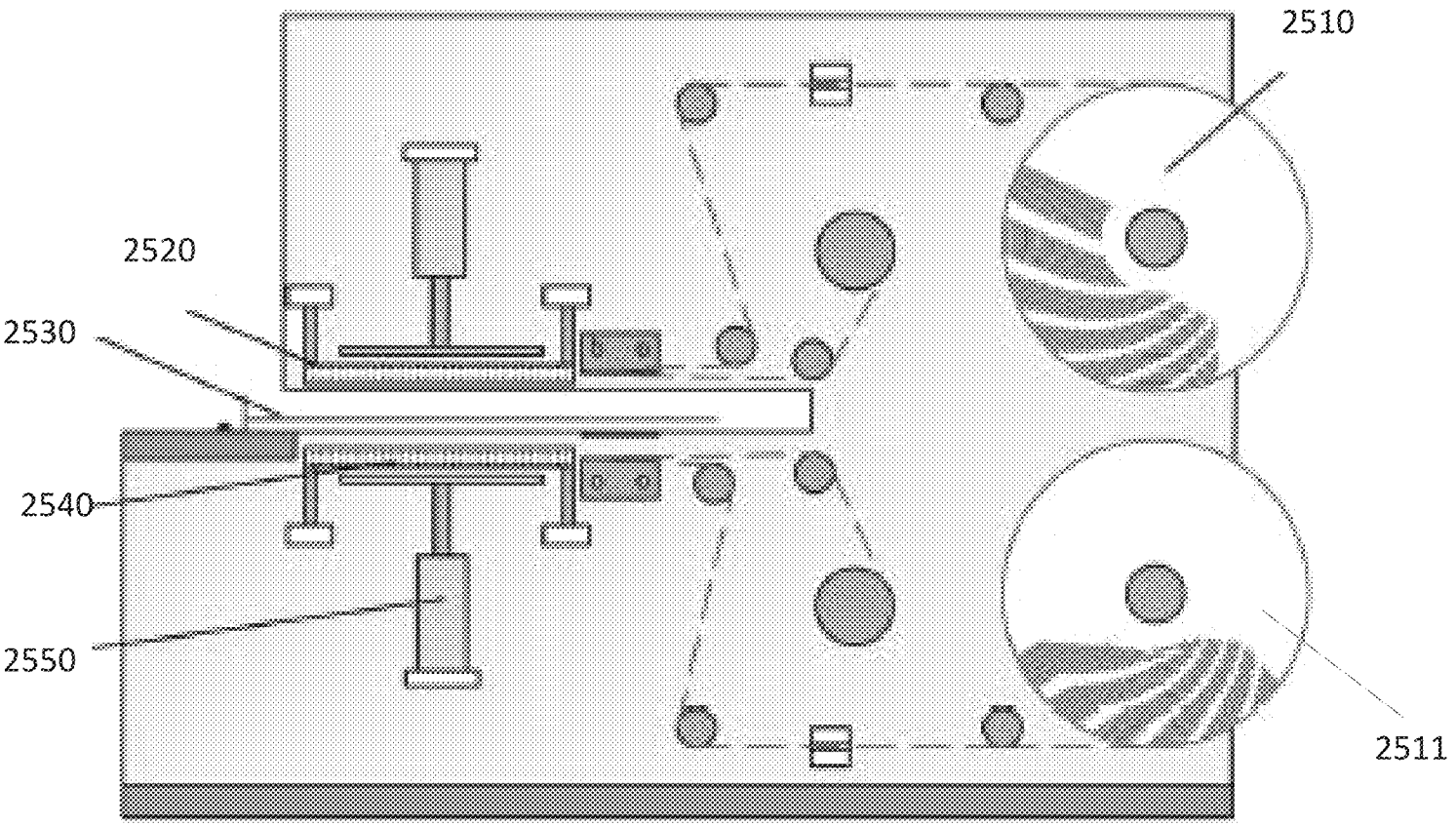
FIG. 25 illustrates a double sided label apparatus in accordance with some aspects of the current disclosure.

FIG. 25 illustrates a double sided label apparatus in accordance with some aspects of the current disclosure. The channel slide label apparatus can be configured to apply labels from either above or below an article. It is therefore possible to make an apparatus that can label both sides of an article simultaneously. The receiving channels for this type of an apparatus may be positioned relatively closer to the article 2530 being labeled so the tamp plates may travel a short distance. In some examples, the tamp plates may be pneumatically operated using a pneumatic piston 2550 and may label both sides of the article at the same time. The tamp plates can be faced with brushes to provide a softer impact when they meet. Labels from label roll 2510 travel to a first transfer assembly 2520 which is used to apply a label onto one side of article 2530. Labels from label roll 2511 travel to a second transfer assembly 2540 which is used to apply a label onto the other side of article 2530.

Figure 26:
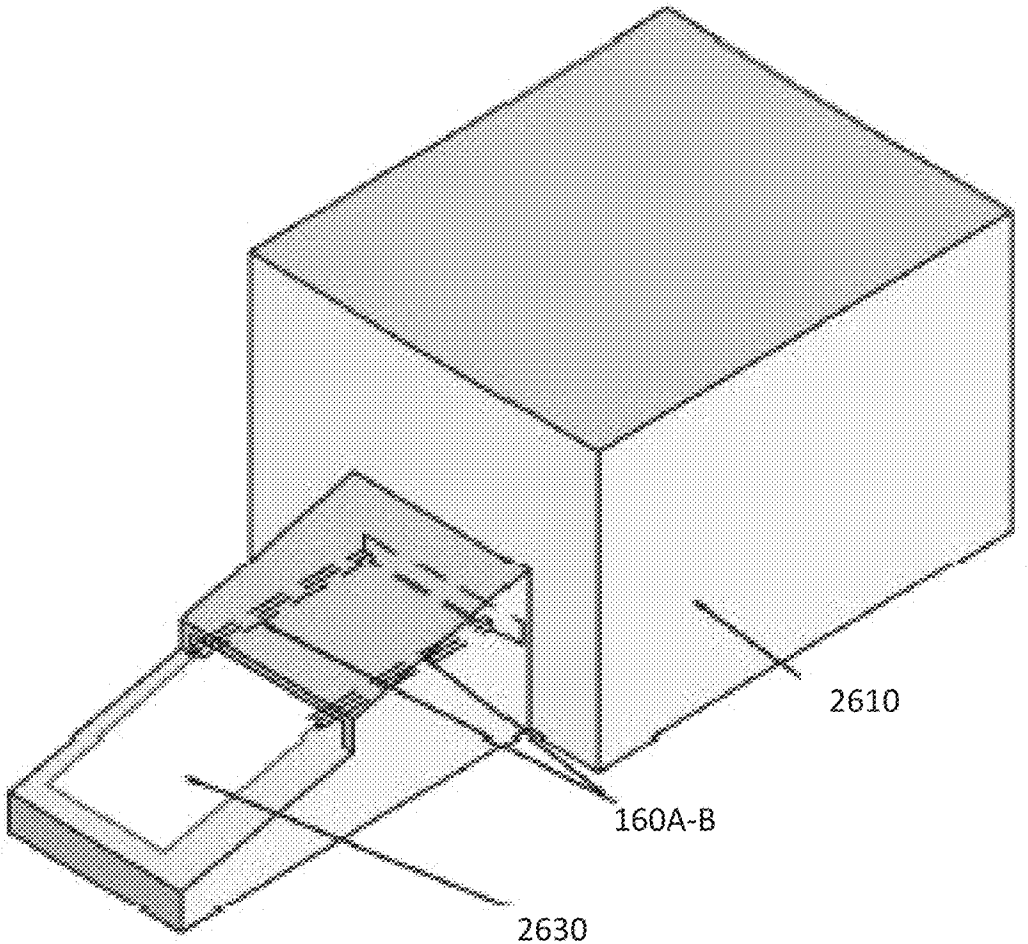
FIG. 26 illustrates a modified wipe on label apparatus in accordance with some aspects of the current disclosure.

FIG. 26 illustrates a modified wipe on label apparatus in accordance with some aspects of the current disclosure. As shown, the receiving channels can be made shorter than the label. The leading edge of the label can project out beyond the end of the channels 160A-B after it is separated from the backing material. The dispensed label 2630 can then be applied to an article with a wipe on motion. Normally, this type of label applicator would require suction to hold onto the label after removal from the backing material. Since the channels hold the label, no suction is required. This can greatly simplify the construction of a wipe on applicator. Thermal label printers on the market today often separate a label from its backing paper and present the label for an operator to pick up and apply. With the addition of receiving channels, a label printer can present a label for a wipe on application. The wipe on applicator would be a more direct way to label items in a repetitive situation and can also result in more accurate label placement than placement by hand. A label printer 2610 is shown to use the modified wipe on applicator where the label is held within the channels 160A-B and the leading edge of the dispensed label rests on the apparatus with an adhesive side up ready to be applied on an article.

Figure 27:
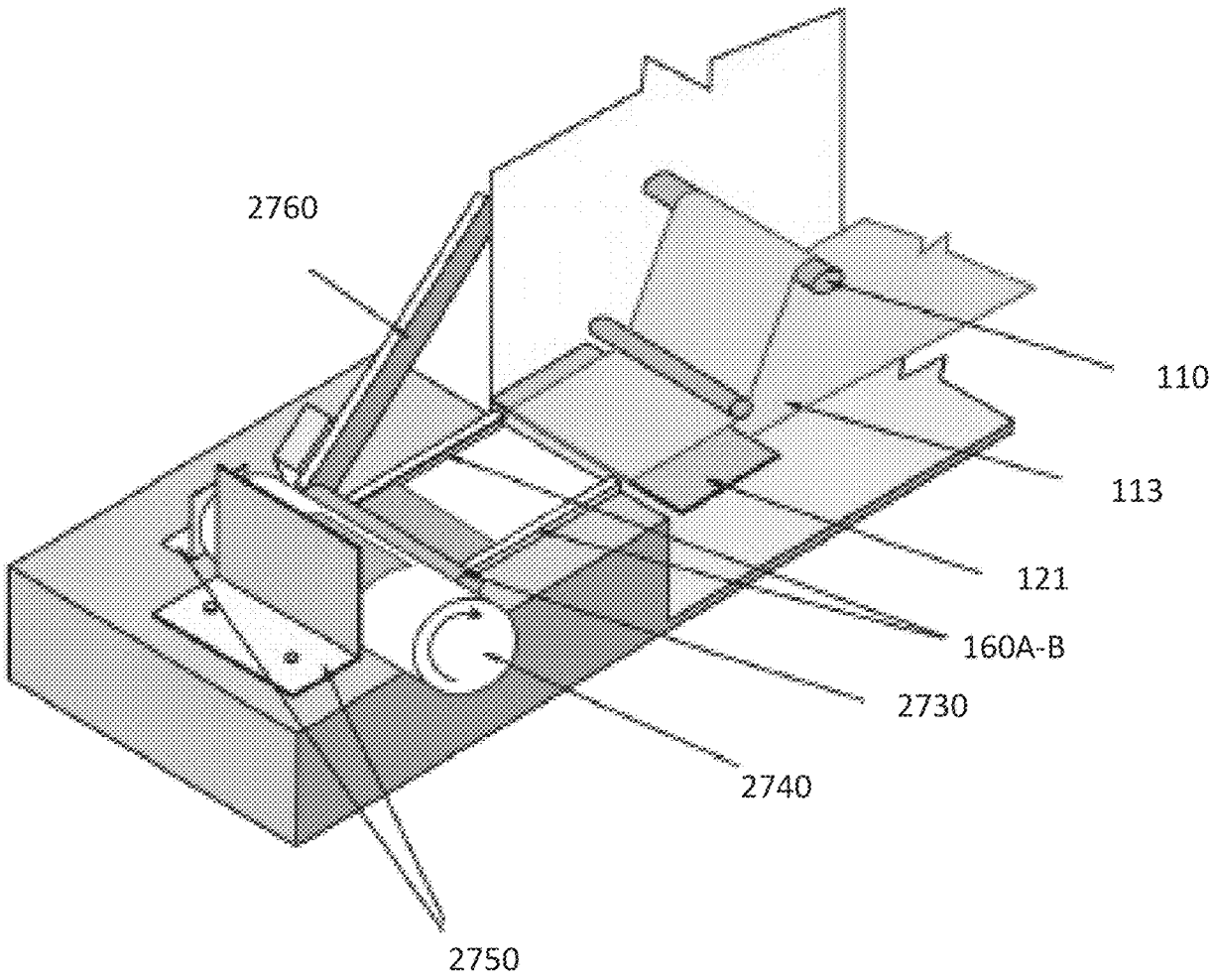
FIG. 27 illustrates a bottle labeler in accordance with some aspects of the current disclosure.

FIG. 27 illustrates a bottle labeler in accordance with some aspects of the current disclosure. As shown in FIG. 27, the wipe on applicator can also be used to label cylindrical bottles 2740. Two guides 2750 may be used to aid in positioning the bottles. A leading edge of the label may protrude out of the channels and dispensed adhesive face up such that the bottle can be placed on top of the label edge and be rotated. Once the label is in the receiving channels 160A-B, the bottle can be placed on the tray holding the label. The bottle can then be spun to apply the label. It can be spun by hand, with a manual crank or with a motorized bottle roller 2730. An adjustable arm 2760 may provide support for the bottle roller.

In the foregoing specification, implementations of the disclosure have been described with reference to specific example implementations thereof. It will be evident that various modifications may be made thereto without departing from the broader spirit and scope of implementations of the disclosure as set forth in the following claims. The specification and drawings are, accordingly, to be regarded in an illustrative sense rather than a restrictive sense. It should be borne in mind, however, that all of these and similar terms are to be associated with the appropriate physical quantities and are merely convenient labels applied to these quantities.

What is claimed is:

1. An apparatus for applying a label to an article, comprising:

a first channel, a second channel, and a peel assembly comprising a peel bar and a pressure bar positioned across the peel bar, wherein the pressure bar is adapted to apply pressure on the label prior to the label being removed from a backing material using the peel bar, wherein the pressure bar comprises moveable rings attached to the pressure bar, the rings adapted to provide smooth surface to apply pressure on the label;

wherein each of the first channel and the second channel comprising a first surface and a second surface positioned opposite the first surface, wherein the second surface comprises a curved edge, the curved edge further comprising an open end curved towards the first surface;

wherein the first surface of each of the first channel and the second channel are adapted to restrict a curvature of the label; and wherein the open end of the second surface of each of the first channel and the second channel are adapted to contact an adhesive side of the label.

2. The apparatus of claim 1, wherein the first channel and the second channel are separated and positioned parallel to each other.

3. The apparatus of claim 1, wherein the first surface of the first channel and the first surface of the second channel are connected to each other.

4. The apparatus of claim 2, wherein a cavity created by the first channel and the second channel is adapted to accommodate an applicator assembly of the apparatus.

5. The apparatus of claim 4, wherein the applicator assembly comprises an applicator with a brush face.

6. The apparatus of claim 1, wherein the first surface is substantially planar.

7. The apparatus of claim 1, wherein the peel assembly further comprises a hinge rod, the hinge rod adapted to rotate the pressure bar to apply pressure on the label.

8. An apparatus for applying a label to an article, comprising:

a peel assembly, the peel assembly comprising a peel member and a pressure member, wherein the peel member and the pressure member are positioned across from each other, wherein the pressure member is adapted to apply pressure on the label prior to the label being removed from a backing material using the peel member, wherein the pressure member comprises moveable rings attached to the pressure member, the rings adapted to provide smooth surface to apply pressure on the label;

a label securing assembly, the label securing assembly comprising a first channel and a second channel, each of the first channel and the second channel comprising a first surface and a second surface positioned opposite the first surface, wherein the second surface comprises a free edge curved towards the first surface; and an applicator assembly comprising a pressure tool.

9. The apparatus of claim 8, wherein the first channel and the second channel are separated and positioned parallel to each other.

10. The apparatus of claim 9, wherein a cavity created by the first channel and the second channel is adapted to accommodate the applicator assembly wherein the pressure tool comprises a brush faced applicator.

11. The apparatus of claim 8, wherein the peel assembly further comprises a hinge rod, the hinge rod adapted to rotate the pressure member to apply pressure on the label.

12. A method for applying a label to an article, comprising:

removing the label from a strip of backing material using a peel assembly;

as the label is being removed from the strip, transferring the label to a label securing assembly comprising a first channel and a second channel, wherein a first surface of both the first channel and the second channel are adapted to restrict a curvature of the label and wherein a curved free edge of a second surface of both the first channel and the second channel are adapted to contact an adhesive side of the label;

moving the label securing assembly towards the article by applying pressure on an applicator assembly connected to a transfer assembly until the label securing assembly reaches the article, the transfer assembly being attached to the label securing assembly; and appending the label on the article by applying pressure on the label against the article.

13. The method of claim 12, wherein removing the label from the strip comprises:

removing the label from the strip while applying pressure on a portion of the label and the backing material using a pressure bar of the peel assembly.

14. The method of claim 12, wherein appending the label on the article comprises:

releasing the label securing assembly from a portion of the applicator assembly to move the label securing assembly away from the article, wherein releasing the label securing assembly releases the label held within the label securing assembly.

15. The method of claim 12, wherein appending the label on the article by applying pressure on the label comprises:

appending a first portion of the label protruding outside of the label securing assembly on the article by applying pressure on the first portion of the label against the article;

extracting a remaining portion of the label from the label securing assembly; and appending the remaining portion of the label on the article by applying pressure on the remaining portion of the label against the article.

* * * * *